US012331528B2

(12) United States Patent
De Rick et al.

(10) Patent No.: US 12,331,528 B2
(45) **Date of Patent: *Jun. 17, 2025**

(54) FLOOR PANEL FOR FORMING A FLOOR COVERING

(71) Applicant: FLOORING INDUSTRIES LIMITED, SARL, Bertrange (LU)

(72) Inventors: Jan Eddy De Rick, Geraardsbergen (BE); Pieter Devos, Koolskamp (BE)

(73) Assignee: UNILIN, BV, Wielsbeke (BE)

( * ) Notice: Subject to any disclaimer, the term of this patent is extended or adjusted under 35 U.S.C. 154(b) by 0 days.

This patent is subject to a terminal disclaimer.

(21) Appl. No.: 18/531,277

(22) Filed: Dec. 6, 2023

(65) Prior Publication Data

US 2024/0110387 A1 Apr. 4, 2024

Related U.S. Application Data

(63) Continuation of application No. 17/546,609, filed on Dec. 9, 2021, now Pat. No. 11,873,647, which is a (Continued)

(30) Foreign Application Priority Data

Jan. 8, 2016 (BE) ..... 2016/5011
Apr. 18, 2016 (DE) ..... 20 2016 102 034.4

(51) Int. Cl.
*E04F 15/02* (2006.01)
*E04F 15/10* (2006.01)

(52) U.S. Cl.
CPC ..... *E04F 15/02038* (2013.01); *E04F 15/105* (2013.01); *E04F 15/107* (2013.01); (Continued)

(58) Field of Classification Search
CPC . E04F 15/02038; E04F 15/105; E04F 15/045; E04F 15/107; E04F 15/072; E04F 2201/0146; E04F 2201/0176; E04F 13/072
See application file for complete search history.

(56) References Cited

U.S. PATENT DOCUMENTS 960,870 A 6/1910 Fields
6,685,391 B1 2/2004 Gideon
(Continued)

FOREIGN PATENT DOCUMENTS

CL 2008001501 A1 1/2009
CN 202055464 U 11/2011
(Continued)

OTHER PUBLICATIONS

Belgian Search Report from BE Application No. BE20160511, Oct. 21, 2016.

(Continued)

*Primary Examiner* — Beth A Stephan
(74) *Attorney, Agent, or Firm* — Workman Nydegger

(57) ABSTRACT

A floor panel for forming a floor covering, wherein the floor covering consists of floor panels, which, on at least one pair of edges, are provided with coupling parts. The coupling parts substantially are manufactured from the material of the floor panel, and the coupling parts are configured such that two such floor panels, at the pair of edges, can be installed and locked to each other by means of a downward movement and/or by means of the fold-down principle.

20 Claims, 12 Drawing Sheets

Related U.S. Application Data continuation of application No. 16/802,879, filed on Feb. 27, 2020, now Pat. No. 11,225,800, which is a continuation of application No. 16/066,973, filed as application No. PCT/IB2016/057706 on Dec. 16, 2016, now Pat. No. 10,648,182.

(60) Provisional application No. 62/398,589, filed on Sep. 23, 2016, provisional application No. 62/274,021, filed on Dec. 31, 2015.

(52) U.S. Cl.
CPC ..... *E04F 2201/0146* (2013.01); *E04F 2201/0176* (2013.01)

(56) References Cited

U.S. PATENT DOCUMENTS

| | | | | |
|---|---|---|---|---|
| 7,685,790 | B2 | 3/2010 | Stone | |
| 8,806,832 | B2 * | 8/2014 | Kell | E04F 15/105 52/592.4 |
| 9,260,870 | B2 | 2/2016 | Vermeulen et al. | |
| 9,556,620 | B2 | 1/2017 | Cappelle et al. | |
| 9,695,851 | B2 | 7/2017 | Hannig | |
| 9,885,187 | B2 * | 2/2018 | Kell | E04F 15/02033 |
| 10,190,611 | B2 | 1/2019 | Hannig | |
| 10,280,627 | B2 | 5/2019 | De Rick et al. | |
| 10,301,830 | B2 | 5/2019 | Boo | |
| 10,407,919 | B2 | 9/2019 | Boo | |
| 10,648,182 | B2 * | 5/2020 | De Rick | E04F 15/107 |
| 10,844,612 | B2 | 11/2020 | Boo | |
| 11,225,800 | B2 * | 1/2022 | De Rick | E04F 15/02038 |
| 11,421,426 | B2 | 8/2022 | Boo | |
| 11,873,647 | B2 * | 1/2024 | De Rick | E04F 15/105 |
| 2003/0145549 | A1 * | 8/2003 | Palsson | B44C 3/123 52/589.1 |
| 2009/0013353 | A1 | 1/2009 | Haziza et al. | |
| 2009/0133353 | A1 | 5/2009 | Pervan et al. | |
| 2009/0249733 | A1 | 10/2009 | Moebus | |
| 2012/0066996 | A1 | 3/2012 | Konstanczak | |
| 2012/0096801 | A1 * | 4/2012 | Cappelle | E04F 15/02038 52/592.1 |
| 2012/0180416 | A1 | 7/2012 | Perra et al. | |
| 2012/0266555 | A1 * | 10/2012 | Cappelle | E04F 15/02194 52/309.1 |
| 2013/0067842 | A1 * | 3/2013 | Meersseman | B32B 3/12 52/311.1 |
| 2013/0097959 | A1 * | 4/2013 | Michel | E04C 2/30 29/557 |
| 2013/0104486 | A1 * | 5/2013 | Windmoller | E04F 15/107 29/428 |
| 2013/0180193 | A1 | 7/2013 | Bossuyt | |
| 2013/0276398 | A1 | 10/2013 | Hannig | |
| 2013/0309441 | A1 | 11/2013 | Hannig | |
| 2014/0283466 | A1 | 9/2014 | Boo | |
| 2015/0240500 | A1 | 8/2015 | Stevens | |
| 2015/0267418 | A1 | 9/2015 | Vermeulen et al. | |
| 2015/0337542 | A1 | 11/2015 | Cappelle et al. | |
| 2017/0037642 | A1 | 2/2017 | Boo | |
| 2017/0268545 | A1 | 9/2017 | Hannig | |
| 2017/0292276 | A1 * | 10/2017 | Cappelle | E04F 15/02038 |
| 2017/0370109 | A1 * | 12/2017 | Devos | E04F 15/02038 |
| 2020/0063441 | A1 | 2/2020 | Boo | |
| 2021/0230881 | A1 | 7/2021 | Boo | |
| 2023/0115427 | A1 | 4/2023 | Boo | |

FOREIGN PATENT DOCUMENTS

| | | | |
|---|---|---|---|
| CN | 202831535 | U | 3/2013 |
| CN | 104912293 | A | 9/2015 |
| CN | 104968873 | A | 10/2015 |
| DE | 20203311 | U1 | 5/2002 |
| DE | 10305695 | A1 | 9/2004 |
| DE | 202011110452 | U1 | 2/2014 |
| DE | 202016102034 | U1 | 5/2016 |
| EP | 2221431 | A1 | 8/2010 |
| EP | 3073026 | A1 | 9/2016 |
| JP | 2012047036 | A | 3/2012 |
| KR | 20150133257 | A | 11/2015 |
| WO | 2005088029 | A1 | 9/2005 |
| WO | 2007141605 | A2 | 12/2007 |
| WO | 2008004960 | A2 | 1/2008 |
| WO | 2012049577 | A2 | 4/2012 |
| WO | 2012126046 | A1 | 9/2012 |
| WO | 2014033628 | A1 | 3/2014 |
| WO | 2014182215 | A1 | 11/2014 |
| WO | 2015104680 | A1 | 7/2015 |

OTHER PUBLICATIONS

International Search Report and Written Opinion from PCT Application No. PCT/IB2016/057706, Mar. 30, 2017.
Eurasian Office Action from Application No. 201891548/31, Aug. 13, 2019.
Chinese Search Report from Application No. 201680776166, Aug. 22, 2019.
Office Action from Corresponding Indian Application No. 201837021709, Dec. 18, 2020.
Office Action from Corresponding JP Application No. JP2018-534723, Mar. 2, 2021.

* cited by examiner

FLOOR PANEL FOR FORMING A FLOOR COVERING

This application is a continuation of U.S. application Ser. No. 17/546,609, filed Dec. 9, 2021, which is a continuation of U.S. application Ser. No. 16/802,879, filed Feb. 27, 2020, now U.S. Pat. No. 11,225,800 issued Jan. 18, 2022, which is a continuation of U.S. application Ser. No. 16/066,973, filed Jun. 28, 2018, now U.S. Pat. No. 10,648,182 issued May 12, 2020, which is a Nationalization of PCT Application PCT/IB2016/057706, filed Dec. 16, 2016, which claims the benefit under 35 U.S.C. 119(e) to the U.S. Provisional Applications 62/274,021 filed on Dec. 31, 2015, and 62/398,589 filed on Sep. 23, 2016.

BACKGROUND OF THE INVENTION

Field of the Invention

This invention relates to a floor panel for forming a floor covering, more particularly for forming a floor covering which can be installed on an underlying surface.

More particularly, the invention relates to floor panels which can be coupled to each other by means of mechanical coupling parts.

SUMMARY OF THE DISCLOSURE

The aim of the invention is that a floor covering of such floor panels can be installed easily, however, that simultaneously also sufficient strength is obtained in the floor covering, more particularly sufficiently strong connections can be realized among the floor panels, such in combination with production techniques which keep the production costs limited.

Primarily, the invention relates to floor panels which can be installed by means of the so-called fold-down technique, such in order to be able to fulfill the targeted requirement of a simple installation. A fact herein is that two of the edges, in the case of oblong floor panels mostly the short edges, must be able to be joined to each other by means of a downward movement, wherein then a vertical locking has to be brought about. A good vertical locking can be realized by means of separate elastic locking strips. However, realizing and providing them is expensive. In order to exclude these costs, one-piece or substantially one-piece of coupling profiles can be used. However, it is known that such coupling parts realized in one piece mostly offer a less stable connection; either the connection is too taut and the floor panels cannot be joined to each other or can only be joined together by damaging them, or the coupling offers too little resistance against unlocking. It seems that the quality of the coupling is extremely dependent on configuration details and applied materials.

The present invention now aims at a number of combinations of characteristics with which significant improvements can be obtained with floor panels with one-piece coupling parts, and in particular with one-piece vertically active coupling parts, such by applying certain structural features and/or material characteristics and/or designs of the coupling parts. These combinations form the basis of a plurality of independent aspects of the invention, which aspects in their turn can be combined at choice, such according to all possible combinations, as far as such combinations are not contradictory. Combinations of two of more of the aspects imply that each time all characteristics of each of the combined aspects are joined. It is explicitly emphasized here that all mathematical combinations are possible among the ten aspects listed herein below, as far as the respectively obtained combination does not include any contradictory characteristics. In this manner, this application thus also forms a reservoir of possibilities of claimed subject-matter. In fact, it is so that the good working of the obtained couplings lies in an interaction of well-defined details, and that by joining the detail combinations of two or more aspects each time an even more specified combination of characteristics is obtained, which then implies a further improvement.

The invention, in other words, the inventive character, of each of the herein below mentioned aspects thus lies substantially in the combinative effect of the respectively claimed combination of measures. The inventor was able to state that well-defined combinations lead to better one-piece couplings, which are usable in floor panels which can be installed according to the fold-down principle, whereby it is not always possible to give specific explanations for this. The advantages achieved by the couplings thus in general lie in an improved floor panel with improved coupling means, wherein the advantage of a simple manufacture, by making use of easy to manufacture coupling parts, namely, because they do not make use of separate connection pieces, the advantage that the floor panels preferably can be installed according to the user-friendly fold-down principle, and the advantage of offering a relatively sturdy coupling, are combined. Herein, the invention primarily provides well-defined characteristics at the edges of the floor panels, where the connection is realized by means of a downward movement, wherein primarily the combinations of characteristics which are applied at these edges are particularly specific and contribute to the targeted effect. The inventor also has found that certain configurations of coupling means in combination with well-defined materials are advantageous.

This thus has led to the herein below described aspects of the invention.

According to a first aspect of the invention, it relates to a floor panel for forming a floor covering,

- wherein this floor panel comprises a first pair of opposite edges, as well as a second pair of opposite edges;
- wherein the first pair of opposite edges comprises coupling parts, which allow that two of such floor panels mutually can be coupled to each other, and wherein said coupling parts show the following characteristics:
  - the coupling parts comprise a horizontally active locking system, which, in a coupled condition of two of such floor panels, effects a locking in the plane of the floor panels and perpendicular to the respective edges;
  - the coupling parts also comprise a vertically active locking system, which, in a coupled condition of two of such floor panels, effects a locking transverse to the plane of the floor panels;
  - the coupling parts substantially are realized from the material of the floor panel itself; and
  - the coupling parts are configured such that two of such panels can be coupled to each other at these edges by means of a turning movement;
- wherein the second pair of opposite edges also comprises coupling parts on both edges, which allow that two of such floor panels mutually can be coupled to each other, and wherein said coupling parts show the following characteristics:
  - the coupling parts comprise a horizontally active locking system, which, in a coupled condition of two of such floor panels, effects a locking in the plane of the floor panels and perpendicular to the respective edges;

the coupling parts also comprise a vertically active locking system, which, in a coupled condition of two of such floor panels, effects a locking transverse to the plane of the floor panels;

the coupling parts substantially are realized from the material of the floor panel itself;

the horizontally active locking system of the second pair of edges is formed at least of an upward-directed lower hook-shaped part which is situated on one of said two edges, as well as a downward-directed upper hook-shaped part, which is situated on the opposite edge, wherein the lower hook-shaped part consists of a lip with an upward-directed locking element, which proximally thereof defines a female part in the form of a recess, whereas the upper hook-shaped part consists of a lip with a downward-directed locking element forming a male part;

the coupling parts are configured such that two of such floor panels can be coupled to each other at their respective edges by means of a downward movement of the one floor panel in respect to the other;

the vertically active locking system comprises vertically active locking parts, which, by means of respective contact surfaces, define at least a first contact zone and a second contact zone, which are situated at opposite sides of the male part and female part;

the aforementioned vertically active locking parts comprise a first locking part and a second locking part at the respective opposite sides of the male part, as well as a third locking part and a fourth locking part at the respective opposite sides of the female part;

the first and third locking part, in the coupled condition of two of such floor panels, define said first contact zone, while having contact surfaces which, in coupled condition, define at least one inclined tangent line;

the second and fourth locking part, in the coupled condition of two of such floor panels, define said second contact zone, while having contact surfaces, which, in the coupled condition, also define at least one inclined tangent line;

said male part has a distal side and a proximal side, wherein the second locking part is situated at the distal side; and said two tangent lines are upwardly inclined towards each other from their respective contact zones, with the characteristic that on the second pair of edges further the following combination of features is present:

the tangent line which is defined by the first and third locking part is steeper in respect to the plane of the floor panel than the tangent line which is defined by the second and fourth locking part, or, in other words, the angle of the first-mentioned tangent line with the horizontal is larger than the angle of the second-mentioned tangent line with the horizontal;

the difference in size between both mentioned angles is at least 5 degrees and preferably at least 10 degrees;

at the male part, at a height lower than the second contact zone, a contact surface is provided, which, in the coupled condition, together with a contact surface at the female part of the then coupled floor panel, forms a support point which limits the movement of the male part in downward direction;

at the distal side of its distal end, the lower hook-shaped part is free from vertically active mechanical locking parts.

The combination defined according to this first aspect provides floor panels which, in coupled condition, offer a coupling at the second pair of opposite edges, of the type of which the coupling parts can be joined into each other by means of a downward movement, and wherein for this type of coupling parts, as a result of the chosen combination of characteristics, a good compromise can be obtained between, on the one hand, the fact that the coupling provides for a sufficiently large locking in vertical direction, and, on the other hand, the fact that the coupling parts still can be joined into each other in a sufficiently smooth manner.

According to a second independent aspect, the invention relates to a floor panel for forming a floor covering, wherein this floor panel comprises a first pair of opposite edges, as well as a second pair of opposite edges;

wherein the first pair of opposite edges comprises coupling parts, which allow that two of such floor panels mutually can be coupled to each other, and wherein said coupling parts show the following characteristics:

the coupling parts comprise a horizontally active locking system, which, in a coupled condition of two of such floor panels, effects a locking in the plane of the floor panels and perpendicular to the respective edges;

the coupling parts also comprise a vertically active locking system, which, in a coupled condition of two of such floor panels, effects a locking transverse to the plane of the floor panels;

the coupling parts substantially are realized from the material of the floor panel itself; and the coupling parts are configured such that two of such panels can be coupled to each other at these edges by means of a turning movement;

wherein the second pair of opposite edges also comprises coupling parts on both edges, which allow that two of such floor panels mutually can be coupled to each other, and wherein said coupling parts show the following characteristics:

the coupling parts comprise a horizontally active locking system, which, in a coupled condition of two of such floor panels, effects a locking in the plane of the floor panels and perpendicular to the respective edges;

the coupling parts also comprise a vertically active locking system, which, in a coupled condition of two of such floor panels, effects a locking transverse to the plane of the floor panels;

the coupling parts substantially are realized from the material of the floor panel itself;

the horizontally active locking system of the second pair of edges is formed at least of an upward-directed lower hook-shaped part which is situated on one of said two edges, as well as a downward-directed upper hook-shaped part, which is situated on the opposite edge, wherein the lower hook-shaped part consists of a lip with an upward-directed locking element, which proximally thereof defines a female part in the form of a recess, whereas the upper hook-shaped part consists of a lip with a downward-directed locking element forming a male part;

the coupling parts are configured such that two of such floor panels can be coupled to each other at their respective edges by means of a downward movement of the one floor panel in respect to the other;

the vertically active locking system comprises vertically active locking parts, which, by means of respective contact surfaces, define at least a first contact zone and a second contact zone, which are situated at opposite sides of the male part and female part;

the aforementioned vertically active locking parts comprise a first locking part and a second locking part at the respective opposite sides of the male part, as well as a third locking part and a fourth locking part at the respective opposite sides of the female part;

the first and third locking part, in the coupled condition of two of such floor panels, define said first contact zone, while having contact surfaces which, in coupled condition, define at least one inclined tangent line;

the second and fourth locking part, in the coupled condition of two of such floor panels, define said second contact zone, while having contact surfaces, which, in the coupled condition, also define at least one inclined tangent line;

said male part has a distal side and a proximal side, wherein the second locking part is situated at the distal side; and said two tangent lines are upwardly inclined towards each other from their respective contact zones, with the characteristic that the second pair of edges also shows the following characteristic:

the second locking part has a contact surface, which, in downward direction, by means of a bend, merges into a lower-situated distal surface, wherein this distal surface in downward direction extends still further in distal direction, more particularly is made sloping in downward direction.

As the distal surface in downward direction is extending still farther in distal direction, an additional locking in vertical direction is offered. This is particularly useful with supple floor panels and/or floor panels which, with temperature differences, will expand to a relatively large extent, such as synthetic material-based floor panels, for example, LVT floor panels. In such case, the risk is high that the edges will be pushed upward and the coupling parts will be pushed away from each other. By this second aspect, the coupling parts will be pushed less smoothly entirely away from each other. In fact, deformations may occur at the edges, however, after the floor panels shrink again, the coupling parts will adjoin each other nicely again. In other floor panels the coupling is useful as well.

Said lower-situated distal surface preferably is substantially flat.

Further, it is also preferred that said lower-situated distal surface forms an angle, or, seen on average, forms an angle with the horizontal which is larger than 75 degrees and still better is larger than degrees and still better is situated between 83 and 88 degrees.

In the most preferred embodiment of a floor panel according to the second aspect, this is also characterized in that below the contact surface of the fourth locking part a lower-situated proximal surface is present on the female part, which surface, in the coupled condition of two of such floor panels, works in conjunction with the aforementioned lower-situated distal surface, or at least will work in conjunction therewith when the male part is moved out of the female part in upward direction.

According to a third independent aspect of the invention, it relates to a floor panel for forming a floor covering, wherein this floor panel comprises a first pair of opposite edges, as well as a second pair of opposite edges;

wherein the first pair of opposite edges comprises coupling parts, which allow that two of such floor panels mutually can be coupled to each other, and wherein said coupling parts show the following characteristics:

the coupling parts comprise a horizontally active locking system, which, in a coupled condition of two of such floor panels, effects a locking in the plane of the floor panels and perpendicular to the respective edges;

the coupling parts also comprise a vertically active locking system, which, in a coupled condition of two of such floor panels, effects a locking transverse to the plane of the floor panels;

the coupling parts substantially are realized from the material of the floor panel itself; and the coupling parts are configured such that two of such panels can be coupled to each other at these edges by means of a turning movement;

wherein the second pair of opposite edges also comprises coupling parts on both edges, which allow that two of such floor panels mutually can be coupled to each other, and wherein said coupling parts show the following characteristics:

the coupling parts comprise a horizontally active locking system, which, in a coupled condition of two of such floor panels, effects a locking in the plane of the floor panels and perpendicular to the respective edges;

the coupling parts also comprise a vertically active locking system, which, in a coupled condition of two of such floor panels, effects a locking transverse to the plane of the floor panels;

the coupling parts substantially are realized from the material of the floor panel itself;

the horizontally active locking system of the second pair of edges is formed at least of an upward-directed lower hook-shaped part which is situated on one of said two edges, as well as a downward-directed upper hook-shaped part, which is situated on the opposite edge, wherein the lower hook-shaped part consists of a lip with an upward-directed locking element, which proximally thereof defines a female part in the form of a recess, whereas the upper hook-shaped part consists of a lip with a downward-directed locking element forming a male part;

the coupling parts are configured such that two of such floor panels can be coupled to each other at their respective edges by means of a downward movement of the one floor panel in respect to the other;

the vertically active locking system comprises vertically active locking parts, which, by means of respective contact surfaces, define at least a first contact zone and a second contact zone, which are situated at opposite sides of the male part and female part;

the aforementioned vertically active locking parts comprise a first locking part and a second locking part at the respective opposite sides of the male part, as well as a third locking part and a fourth locking part at the respective opposite sides of the female part;

the first and third locking part, in the coupled condition of two of such floor panels, define said first contact zone, while having contact surfaces which, in coupled condition, define at least one inclined tangent line;

the second and fourth locking part, in the coupled condition of two of such floor panels, define said second contact zone, while having contact surfaces, which, in the coupled condition, also define at least one inclined tangent line;

said male part has a distal side and a proximal side, wherein the second locking part is situated at the distal side; and said two tangent lines are upwardly inclined towards each other from their respective contact zones, with the characteristic that the second pair of edges also shows the following characteristic:

on the proximal side of the female part, above the second contact zone a proximal surface is provided, which, in respect to the recess of the female part, is inwardly inclined in upward direction.

The proximal surface mentioned in respect to the third aspect preferably is substantially flat and preferably extends up to the upper surface of the floor panel, either up to the flat upper surface, or up to the upper surface of a chamfer which is present at the floor panel.

Preferably, such floor panel, which is realized according to the third aspect, further is characterized in that said proximal surface forms an angle with the horizontal which is larger than 75 degrees and better is larger than 80 degrees and still better is situated between 83 and 88 degrees.

It is also preferred that above the contact surface of the second locking part a higher-situated distal surface is present at the male part, which, in the coupled condition of two of such floor panels, works in conjunction with the aforementioned proximal surface, or anyway will at least work in conjunction therewith when the male part is moved out of the female part in upward direction. It is clear that in this manner an additional vertical locking is offered.

The male part can form a dovetail with the formed thereon local locking portion halfway of the distal dovetail side.

According to a fourth independent aspect of the invention, it relates to a floor panel for forming a floor covering, wherein this floor panel comprises a first pair of opposite edges, as well as a second pair of opposite edges;

wherein the first pair of opposite edges comprises coupling parts, which allow that two of such floor panels mutually can be coupled to each other, and wherein said coupling parts show the following characteristics:

the coupling parts comprise a horizontally active locking system, which, in a coupled condition of two of such floor panels, effects a locking in the plane of the floor panels and perpendicular to the respective edges;

the coupling parts also comprise a vertically active locking system, which, in a coupled condition of two of such floor panels, effects a locking transverse to the plane of the floor panels;

the coupling parts substantially are realized from the material of the floor panel itself; and the coupling parts are configured such that two of such panels can be coupled to each other at these edges by means of a turning movement;

wherein the second pair of opposite edges also comprises coupling parts on both edges, which allow that two of such floor panels mutually can be coupled to each other, and wherein said coupling parts show the following characteristics:

the coupling parts comprise a horizontally active locking system, which, in a coupled condition of two of such floor panels, effects a locking in the plane of the floor panels and perpendicular to the respective edges;

the coupling parts also comprise a vertically active locking system, which, in a coupled condition of two of such floor panels, effects a locking transverse to the plane of the floor panels;

the coupling parts substantially are realized from the material of the floor panel itself;

the horizontally active locking system of the second pair of edges is formed at least of an upward-directed lower hook-shaped part which is situated on one of said two edges, as well as a downward-directed upper hook-shaped part, which is situated on the opposite edge, wherein the lower hook-shaped part consists of a lip with an upward-directed locking element, which proximally thereof defines a female part in the form of a recess, whereas the upper hook-shaped part consists of a lip with a downward-directed locking element forming a male part;

the coupling parts are configured such that two of such floor panels can be coupled to each other at their respective edges by means of a downward movement of the one floor panel in respect to the other;

the vertically active locking system comprises vertically active locking parts, which, by means of respective contact surfaces, define at least a first contact zone and a second contact zone, which are situated at opposite sides of the male part and female part;

the aforementioned vertically active locking parts comprise a first locking part and a second locking part at the respective opposite sides of the male part, as well as a third locking part and a fourth locking part at the respective opposite sides of the female part;

the first and third locking part, in the coupled condition of two of such floor panels, define said first contact zone, while having contact surfaces which, in coupled condition, define at least one inclined tangent line;

the second and fourth locking part, in the coupled condition of two of such floor panels, define said second contact zone, while having contact surfaces, which, in the coupled condition, also define at least one inclined tangent line;

said male part has a distal side and a proximal side, wherein the second locking part is situated at the distal side; and said two tangent lines are upwardly inclined towards each other from their respective contact zones, with the characteristic that the second pair of edges also shows the following characteristic:

the two contact surfaces of the second contact zone, including possible extensions thereof, seen in cross-section, extend to the left as well as to the right of the respective closing surface, wherein the closing surface is defined as a vertical plane through the upper edges of the coupled floor panels, or at least the location where the floor panels meet each other at the top.

More particularly, it is preferred that in the coupled condition the effective contact between the second contact surface and the fourth contact surface takes place at the one as well as the other side of said vertical surface.

Such positioning of the second contact zone at opposite sides of the closing surface enables bringing the respective coupling parts smoothly into coupled condition, primarily by means of the so-called fold-down technique, whereas a relatively good locking against upward uncoupling is maintained.

According to a fifth independent aspect of the invention, it relates to a floor panel for forming a floor covering;

wherein this floor panel comprises a first pair of opposite edges, as well as a second pair of opposite edges;

wherein the first pair of opposite edges comprises coupling parts, which allow that two of such floor panels mutually can be coupled to each other, and wherein said coupling parts show the following characteristics:

the coupling parts comprise a horizontally active locking system, which, in a coupled condition of two of such floor panels, effects a locking in the plane of the floor panels and perpendicular to the respective edges;

the coupling parts also comprise a vertically active locking system, which, in a coupled condition of two of such floor panels, effects a locking transverse to the plane of the floor panels;

the coupling parts substantially are realized from the material of the floor panel itself; and the coupling parts are configured such that two of such panels can be coupled to each other at these edges by means of a turning movement;

wherein the second pair of opposite edges also comprises coupling parts on both edges, which allow that two of such floor panels mutually can be coupled to each other, and wherein said coupling parts show the following characteristics:

the coupling parts comprise a horizontally active locking system, which, in a coupled condition of two of such floor panels, effects a locking in the plane of the floor panels and perpendicular to the respective edges;

the coupling parts also comprise a vertically active locking system, which, in a coupled condition of two of such floor panels, effects a locking transverse to the plane of the floor panels;

the coupling parts substantially are realized from the material of the floor panel itself;

the horizontally active locking system of the second pair of edges is formed at least of an upward-directed lower hook-shaped part which is situated on one of said two edges, as well as a downward-directed upper hook-shaped part, which is situated on the opposite edge, wherein the lower hook-shaped part consists of a lip with an upward-directed locking element, which proximally thereof defines a female part in the form of a recess, whereas the upper hook-shaped part consists of a lip with a downward-directed locking element forming a male part;

the coupling parts are configured such that two of such floor panels can be coupled to each other at their respective edges by means of a downward movement of the one floor panel in respect to the other;

the vertically active locking system comprises vertically active locking parts, which, by means of respective contact surfaces, define at least a first contact zone and a second contact zone, which are situated at opposite sides of the male part and female part;

the aforementioned vertically active locking parts comprise a first locking part and a second locking part at the respective opposite sides of the male part, as well as a third locking part and a fourth locking part at the respective opposite sides of the female part;

the first and third locking part, in the coupled condition of two of such floor panels, define said first contact zone, while having contact surfaces which, in coupled condition, define at least one inclined tangent line;

the second and fourth locking part, in the coupled condition of two of such floor panels, define said second contact zone, while having contact surfaces, which, in the coupled condition, also define at least one inclined tangent line;

said male part has a distal side and a proximal side, wherein the second locking part is situated at the distal side; and said two tangent lines are upwardly inclined towards each other from their respective contact zones, with the characteristic that the second pair of edges further shows the following characteristics:

at the male part, at a height lower than the second contact zone, a contact surface is provided, which, in the coupled condition, together with a contact surface on the then coupled floor panel, forms a support point which limits the movement of the male part in downward direction;

the coupling parts at the second pair of edges also show one of the following three characteristics or any combination of two or three of these characteristics:

at the distal side of its distal end, the lower hook-shaped part is free from vertically active mechanical locking parts;

the contact surfaces forming said support point are situated on the lower side of the male part and on the upper side of the lip of the lower hook-shaped part, respectively, wherein in coupled condition, distally from this support point a space remains present between the lower side of the male part and the upper side of said lip, this preferably underneath the entire portion of the male part situated distally from said support point, wherein this space preferably is formed in that a portion of the upper side of the lip is situated deeper than the support point, and/or wherein this space, seen in a cross-section of the respective edge, preferably extends over a distance which is at least ⅓ of the width of the male part;

at the lower side of the lip of the lower hook-shaped part, a recess is present, which extends up to the distal end of the lip and which allows a bending of the lip in downward direction.

The configuration according to the fifth aspect allows that the coupling parts can be placed accurately in each other.

According to a sixth independent aspect of the invention, it relates to a floor panel for forming a floor covering, wherein this floor panel comprises a first pair of opposite edges, as well as a second pair of opposite edges;

wherein the first pair of opposite edges comprises coupling parts, which allow that two of such floor panels mutually can be coupled to each other, and wherein said coupling parts show the following characteristics:

the coupling parts comprise a horizontally active locking system, which, in a coupled condition of two of such floor panels, effects a locking in the plane of the floor panels and perpendicular to the respective edges;

the coupling parts also comprise a vertically active locking system, which, in a coupled condition of two of such floor panels, effects a locking transverse to the plane of the floor panels;

the coupling parts substantially are realized from the material of the floor panel itself; and the coupling parts are configured such that two of such panels can be coupled to each other at these edges by means of a turning movement;

wherein the second pair of opposite edges also comprises coupling parts on both edges, which allow that two of such floor panels mutually can be coupled to each other, and wherein said coupling parts show the following characteristics:

the coupling parts comprise a horizontally active locking system, which, in a coupled condition of two of such floor panels, effects a locking in the plane of the floor panels and perpendicular to the respective edges;

the coupling parts also comprise a vertically active locking system, which, in a coupled condition of two of such floor panels, effects a locking transverse to the plane of the floor panels;

the coupling parts substantially are realized from the material of the floor panel itself;

the horizontally active locking system of the second pair of edges is formed at least of an upward-directed lower hook-shaped part which is situated on one of said two edges, as well as a downward-directed upper hook-shaped part, which is situated on the opposite edge, wherein the lower hook-shaped part consists of a lip with an upward-directed locking element, which proximally thereof defines a female part in the form of a recess, whereas the upper hook-shaped part consists of a lip with a downward-directed locking element forming a male part;

the coupling parts are configured such that two of such floor panels can be coupled to each other at their respective edges by means of a downward movement of the one floor panel in respect to the other;

the vertically active locking system comprises vertically active locking parts, which, by means of respective contact surfaces, define at least a first contact zone and a second contact zone, which are situated at opposite sides of the male part and female part;

the aforementioned vertically active locking parts comprise a first locking part and a second locking part at the respective opposite sides of the male part, as well as a third locking part and a fourth locking part at the respective opposite sides of the female part;

the first and third locking part, in the coupled condition of two of such floor panels, define said first contact zone, while having contact surfaces which, in coupled condition, define at least one inclined tangent line;

the second and fourth locking part, in the coupled condition of two of such floor panels, define said second contact zone, while having contact surfaces, which, in the coupled condition, also define at least one inclined tangent line;

said male part has a distal side and a proximal side, wherein the second locking part is situated at the distal side; and said two tangent lines are upwardly inclined towards each other from their respective contact zones, with the characteristic that on the second pair of edges further the following combination of characteristics is present:

the contact surfaces of the second and fourth locking part, and possible extensions of these surfaces, are made flat or substantially flat;

the contact surfaces of the second and fourth locking part, and more particularly the tangent line defined thereby, form an angle with the horizontal which is larger than 70 degrees, and still better is larger than 75 degrees, however, preferably is smaller than 85 degrees;

the contact surfaces of the second and fourth locking part, and possible extensions of these surfaces, in upward direction each terminate at locations which are situated lower than the upper surface of the floor panels;

starting from the upper ends of the contact surfaces of the second and fourth locking part, and from possible extensions of these surfaces, up to the upper surface of the floor panel, lateral edge portions are formed, which extend more straight upward than said contact surfaces and preferably are vertical or approximately vertical;

at the lower edges of the male part, guiding surfaces, such as inclined parts or rounded parts, are present, which are configured such that the male part during the downward movement thereof automatically is guided into the female part.

The embodiment according to the sixth aspect allows that, seen in cross-section, the contact surfaces in the second contact zone can be realized such that they can work in conjunction with each other over a relatively long distance, which results in a good mutual support. The sixth aspect also allows that the contact surfaces of the second contact zone can engage behind each other with a small force, which is particularly useful when no special other measures are provided to this aim.

According to a seventh independent aspect of the invention, it relates to a floor panel for forming a floor covering, wherein this floor panel comprises a first pair of opposite edges, as well as a second pair of opposite edges;

wherein the first pair of opposite edges comprises coupling parts, which allow that two of such floor panels mutually can be coupled to each other, and wherein said coupling parts show the following characteristics:

the coupling parts comprise a horizontally active locking system, which, in a coupled condition of two of such floor panels, effects a locking in the plane of the floor panels and perpendicular to the respective edges;

the coupling parts also comprise a vertically active locking system, which, in a coupled condition of two of such floor panels, effects a locking transverse to the plane of the floor panels;

the coupling parts substantially are realized from the material of the floor panel itself; and the coupling parts are configured such that two of such panels can be coupled to each other at these edges by means of a turning movement;

wherein the second pair of opposite edges also comprises coupling parts on both edges, which allow that two of such floor panels mutually can be coupled to each other, and wherein said coupling parts show the following characteristics:

the coupling parts comprise a horizontally active locking system, which, in a coupled condition of two of such floor panels, effects a locking in the plane of the floor panels and perpendicular to the respective edges;

the coupling parts also comprise a vertically active locking system, which, in a coupled condition of two of such floor panels, effects a locking transverse to the plane of the floor panels;

the coupling parts substantially are realized from the material of the floor panel itself;

the horizontally active locking system of the second pair of edges is formed at least of an upward-directed lower hook-shaped part which is situated on one of said two edges, as well as a downward-directed upper hook-shaped part, which is situated on the opposite edge, wherein the lower hook-shaped part consists of a lip with an upward-directed locking element, which proximally thereof defines a female part in the form of a recess, whereas the upper hook-shaped part consists of a lip with a downward-directed locking element forming a male part;

the coupling parts are configured such that two of such floor panels can be coupled to each other at their respective edges by means of a downward movement of the one floor panel in respect to the other;

the vertically active locking system comprises vertically active locking parts, which, by means of respective contact surfaces, define at least a first contact zone and a second contact zone, which are situated at opposite sides of the male part and female part;

the aforementioned vertically active locking parts comprise a first locking part and a second locking part at the respective opposite sides of the male part, as well as a third locking part and a fourth locking part at the respective opposite sides of the female part;

the first and third locking part, in the coupled condition of two of such floor panels, define said first contact zone, while having contact surfaces which, in coupled condition, define at least one inclined tangent line;

the second and fourth locking part, in the coupled condition of two of such floor panels, define said second contact zone, while having contact surfaces, which, in the coupled condition, also define at least one inclined tangent line;

said male part has a distal side and a proximal side, wherein the second locking part is situated at the distal side; and said two tangent lines are upwardly inclined towards each other from their respective contact zones, with the characteristic that at the second pair of edges further the following characteristic is present:

the lip of the lower hook-shaped part, seen in a cross-section transverse to the respective edge, is characterized by a first longitudinal portion, being the portion extending from the proximal end of the lower hook-shaped part up to the location where the upward-directed locking element is starting, and by a second longitudinal portion, which is defined as being the most distal 75% of the first longitudinal portion, wherein the lip is reduced in thickness by at least 5%, and better at least 10% and still better at least 30% inside the aforementioned second longitudinal portion, such while preferably the distal side of the distal end of the lower hook-shaped part is free from vertically active locking parts.

The herein above-mentioned seventh aspect primarily contributes to a suitable suppleness in the lip of the lower hook-shaped part.

According to an eighth independent aspect of the invention, it relates to a floor panel for forming a floor covering, wherein this floor panel comprises a first pair of opposite edges, as well as a second pair of opposite edges;

wherein the first pair of opposite edges comprises coupling parts, which allow that two of such floor panels mutually can be coupled to each other, and wherein said coupling parts show the following characteristics:

the coupling parts comprise a horizontally active locking system, which, in a coupled condition of two of such floor panels, effects a locking in the plane of the floor panels and perpendicular to the respective edges;

the coupling parts also comprise a vertically active locking system, which, in a coupled condition of two of such floor panels, effects a locking transverse to the plane of the floor panels;

the coupling parts substantially are realized from the material of the floor panel itself; and the coupling parts are configured such that two of such panels can be coupled to each other at these edges by means of a turning movement;

wherein the second pair of opposite edges also comprises coupling parts on both edges, which allow that two of such floor panels mutually can be coupled to each other, and wherein said coupling parts show the following characteristics:

the coupling parts comprise a horizontally active locking system, which, in a coupled condition of two of such floor panels, effects a locking in the plane of the floor panels and perpendicular to the respective edges;

the coupling parts also comprise a vertically active locking system, which, in a coupled condition of two of such floor panels, effects a locking transverse to the plane of the floor panels;

the coupling parts substantially are realized from the material of the floor panel itself;

the horizontally active locking system of the second pair of edges is formed at least of an upward-directed lower hook-shaped part which is situated on one of said two edges, as well as a downward-directed upper hook-shaped part, which is situated on the opposite edge, wherein the lower hook-shaped part consists of a lip with an upward-directed locking element, which proximally thereof defines a female part in the form of a recess, whereas the upper hook-shaped part consists of a lip with a downward-directed locking element forming a male part;

the coupling parts are configured such that two of such floor panels can be coupled to each other at their respective edges by means of a downward movement of the one floor panel in respect to the other;

the vertically active locking system comprises vertically active locking parts, which, by means of respective contact surfaces, define at least a first contact zone and a second contact zone, which are situated at opposite sides of the male part and female part;

the aforementioned vertically active locking parts comprise a first locking part and a second locking part at the respective opposite sides of the male part, as well as a third locking part and a fourth locking part at the respective opposite sides of the female part;

the first and third locking part, in the coupled condition of two of such floor panels, define said first contact zone, while having contact surfaces which, in coupled condition, define at least one inclined tangent line;

the second and fourth locking part, in the coupled condition of two of such floor panels, define said second contact zone, while having contact surfaces, which, in the coupled condition, also define at least one inclined tangent line;

said male part has a distal side and a proximal side, wherein the second locking part is situated at the distal side; and said two tangent lines are upwardly inclined towards each other from their respective contact zones, with the characteristic that the second pair of edges further shows the following combination of characteristics:

at the lower side of the lower hook-shaped part, a recess is present which extends from a certain location at the lower side up to the end of the lower hook-shaped part; and seen in cross-section, said location is situated proximally from the upward-directed locking element, and preferably at a horizontal distance therefrom, which is more than 1/10 of the overall thickness of the floor panel.

The eighth aspect, too, contributes to a suitable suppleness in the lip of the lower hook-shaped part.

According to a ninth independent aspect of the invention, it relates to a floor panel for forming a floor covering, wherein this floor panel comprises a first pair of opposite edges, as well as a second pair of opposite edges;

wherein the first pair of opposite edges comprises coupling parts, which allow that two of such floor panels mutually can be coupled to each other, and wherein said coupling parts show the following characteristics:

the coupling parts comprise a horizontally active locking system, which, in a coupled condition of two of such floor panels, effects a locking in the plane of the floor panels and perpendicular to the respective edges;

the coupling parts also comprise a vertically active locking system, which, in a coupled condition of two of such floor panels, effects a locking transverse to the plane of the floor panels;

the coupling parts substantially are realized from the material of the floor panel itself; and the coupling parts are configured such that two of such panels can be coupled to each other at these edges by means of a turning movement;

wherein the second pair of opposite edges also comprises coupling parts on both edges, which allow that two of such floor panels mutually can be coupled to each other, and wherein said coupling parts show the following characteristics:

the coupling parts comprise a horizontally active locking system, which, in a coupled condition of two of such floor panels, effects a locking in the plane of the floor panels and perpendicular to the respective edges;

the coupling parts also comprise a vertically active locking system, which, in a coupled condition of two of such floor panels, effects a locking transverse to the plane of the floor panels;

the coupling parts substantially are realized from the material of the floor panel itself;

the horizontally active locking system of the second pair of edges is formed at least of an upward-directed lower hook-shaped part which is situated on one of said two edges, as well as a downward-directed upper hook-shaped part, which is situated on the opposite edge, wherein the lower hook-shaped part consists of a lip with an upward-directed locking element, which proximally thereof defines a female part in the form of a recess, whereas the upper hook-shaped part consists of a lip with a downward-directed locking element forming a male part;

the coupling parts are configured such that two of such floor panels can be coupled to each other at their respective edges by means of a downward movement of the one floor panel in respect to the other;

the vertically active locking system comprises vertically active locking parts, which, by means of respective contact surfaces, define at least a first contact zone and a second contact zone, which are situated at opposite sides of the male part and female part;

the aforementioned vertically active locking parts comprise a first locking part and a second locking part at the respective opposite sides of the male part, as well as a third locking part and a fourth locking part at the respective opposite sides of the female part;

the first and third locking part, in the coupled condition of two of such floor panels, define said first contact zone, while having contact surfaces, which, in coupled condition, define at least one inclined tangent line;

the second and fourth locking part, in the coupled condition of two of such floor panels, define said second contact zone, while having contact surfaces, which, in the coupled condition, also define at least one inclined tangent line;

said male part has a distal side and a proximal side, wherein the second locking part is situated at the distal side; and said two tangent lines are upwardly inclined towards each other from their respective contact zones;

with the characteristic that the floor panel comprises a composed substrate, which consists at least of two substrate layers each having a well-defined thickness, namely a first synthetic material-based substrate layer and a second substrate layer preferably situated directly there above, which second substrate layer has a thickness of at least 0.5 mm, preferably at least 1 mm; wherein this composed substrate also shows one of the following characteristics or any combination of these characteristics:

the density of the first substrate layer is different from the density of the second substrate layer, and preferably the second substrate layer has a higher density than the first substrate layer;

the first substrate layer is foamed, and preferably is of the closed cell type and still more preferably of the so-called hard foam type, and preferably the second substrate layer is not foamed or is less foamed than the first substrate layer;

the first substrate layer is extruded in a plate shape or is formed by means of a strewing process and consolidation of the strewn material to a plate;

the second substrate layer consists of an extruded layer or of a layer which is formed by means of a strewing process and consolidation of the strewn material.

the two substrate layers are glued to each other or, alternatively, are consolidated in the same production process; this latter, for example, by mutual direct adhesion between the materials of the substrates, or, for example, also by forming them from a single composed mass with at least two layers;

at least one of the aforementioned contact zones, and preferably both, are situated at least partially and preferably entirely in the first substrate layer.

The ninth aspect provides an optimized floor panel, as herein it is started from a well-defined basic material, namely a composed substrate as defined herein above, wherein it has shown that the respective coupling parts of the second pair of edges hereby will show their benefits best, when thus being applied in such substrate.

According to a tenth independent aspect, the invention relates to a floor panel for forming a floor covering, wherein this floor panel comprises a first pair of opposite edges, as well as a second pair of opposite edges;

wherein the first pair of opposite edges comprises coupling parts, which allow that two of such floor panels mutually can be coupled to each other, and wherein said coupling parts show the following characteristics:

the coupling parts comprise a horizontally active locking system, which, in a coupled condition of two of such floor panels, effects a locking in the plane of the floor panels and perpendicular to the respective edges;

the coupling parts also comprise a vertically active locking system, which, in a coupled condition of two of such floor panels, effects a locking transverse to the plane of the floor panels;

the coupling parts substantially are realized from the material of the floor panel itself; and the coupling parts are configured such that two of such panels can be coupled to each other at these edges by means of a turning movement;

wherein the second pair of opposite edges also comprises coupling parts on both edges, which allow that two of such floor panels mutually can be coupled to each other, and wherein said coupling parts show the following characteristics:

the coupling parts comprise a horizontally active locking system, which, in a coupled condition of two of such floor panels, effects a locking in the plane of the floor panels and perpendicular to the respective edges;

the coupling parts also comprise a vertically active locking system, which, in a coupled condition of two of such floor panels, effects a locking transverse to the plane of the floor panels;

the coupling parts substantially are realized from the material of the floor panel itself;

the horizontally active locking system of the second pair of edges is formed at least of an upward-directed lower hook-shaped part which is situated on one of said two edges, as well as a downward-directed upper hook-shaped part, which is situated on the opposite edge, wherein the lower hook-shaped part consists of a lip with an upward-directed locking element, which proximally thereof defines a female part in the form of a recess, whereas the upper hook-shaped part consists of a lip with a downward-directed locking element forming a male part;

the coupling parts are configured such that two of such floor panels can be coupled to each other at their respective edges by means of a downward movement of the one floor panel in respect to the other;

the vertically active locking system comprises vertically active locking parts, which, by means of respective contact surfaces, define at least a first contact zone and a second contact zone, which are situated at opposite sides of the male part and female part;

the aforementioned vertically active locking parts comprise a first locking part and a second locking part at the respective opposite sides of the male part, as well as a third locking part and a fourth locking part at the respective opposite sides of the female part;

the first and third locking part, in the coupled condition of two of such floor panels, define said first contact zone, while having contact surfaces which, in coupled condition, define at least one inclined tangent line;

the second and fourth locking part, in the coupled condition of two of such floor panels, define said second contact zone, while having contact surfaces, which, in the coupled condition, also define at least one inclined tangent line;

said male part has a distal side and a proximal side, wherein the second locking part is situated at the distal side; and said two tangent lines are upwardly inclined towards each other from their respective contact zones;

characterized in that the upward-directed locking element, the downward-directed locking element and the pertaining contact surfaces of the first contact zone are configured such that the upward-directed locking element with its pertaining contact surface, in the coupled condition, adopts a somewhat tilted position in respect to the position which this contact surface takes in the free condition; and that both contact surfaces of the first contact zone in the not-coupled condition mutually are oriented deviating in such a manner that in the coupled condition a less deviating or not deviating orientation in mutual respect is obtained. This offers the advantage that the contact surfaces in the coupled condition are better adapted to each other and a better vertical locking is obtained. More specifically, the relation between the required compression force for realizing the coupling and the quality of the required locking are influenced in an advantageous manner.

According to preferred embodiments, a floor panel of the tenth aspect is characterized in that:

the contact surfaces of the first contact zone, in coupled condition, coincide with each other or approximately coincide with each other; and/or that said contact surfaces, when for their free condition the contours thereof are presented over each other, approach each other in downward direction, or, in other words, provide for a decreasing overlapping in downward direction; and/or that said contact surfaces are substantially flat and that, when for their free condition the contours thereof are presented over each other, the respective contact surfaces show an angle difference of 2 to 10 degrees; and/or that the tangent line determined by said second contact zone forms an angle with the horizontal which is smaller than 65°, and still better is smaller than 60°, and still better even smaller than 55°, and still better is 45 to 52 degrees, or alternatively is 45 degrees or is even smaller than 45 degrees.

The last-mentioned values of angles for the tangent line of the second contact zone can also be applied in embodiments according to the other aspects, this as far as according to such aspect this is not contradictory to already claimed angle values.

A floor panel according to any of the herein above mentioned aspects further may be characterized according to the invention in that it further has one or more of the following characteristics, or any combination of these characteristics in mutual respect, and/or in combination with any of the characteristics of the already explained aspects, such as far as such combination does not comprise contradictory characteristics:

- the floor panel as such combines two or more of the feature combinations of the aforementioned independent claims and possible claims dependent therefrom, wherein each combination comes into question which does not include contradictory characteristics;
- the coupling parts are realized such at the floor panel that the floor panels can be installed according to the fold-down principle;
- the floor panel is oblong rectangular and the first pair of opposite edges forms the long sides of the floor panel, whereas the second pair of opposite edges forms the short sides of the floor panel;
- the coupling parts at the second pair of edges can be joined into each other by means of a downward snap movement;
- the coupling parts at the first and/or second pair of edges are made substantially as profiled parts in the material of the floor panel, preferably substantially or entirely by means of a machining treatment, preferably by means of one or more milling treatments, for example, with milling cutters which are active under different operative angles;
- the coupling parts at the first and/or second pair of edges are made as millable profiled parts, which can be milled by means of milling cutters with a rotational axis which during milling is situated external to the floor panels;
- the aforementioned male part is or is not split;
- at the second pair of edges, only one male part is applied, whether or not split;
- at the aforementioned male part, only one vertically active locking part is present, which defines a tangent line of less than 70 degrees with the horizontal, whereas other, one or more, vertically active locking parts with a tangent line of 70 degrees or more may be present indeed;
- the contact surfaces of the second and/or fourth locking part, and preferably of both, is, are, respectively, made flat;
- the contact surfaces of the second and/or fourth locking part, and preferably of both, is, are, respectively, made curved; herein, the contact surface of the fourth locking part preferably is convex, whereas the contact surface of the second locking part is flat or curved, and preferably is concave;
- the lower hook-shaped part and more particularly the lip thereof is resiliently bendable and/or deformable;
- at the bottom of the lip, a recess is present, preferably configured such that the upward-directed locking element is elastically tiltable;
- in coupled condition, a downward-directed support point is provided at the male part;
- underneath the male part, a space is present;
- the recess and/or support point and/or space mentioned in the preceding paragraphs of this list are configured such as already explained in the previously described independent aspects;
- in coupled condition, a space is present behind the distal end of the lower hook-shaped part;
- in coupled condition, a space is present above the upward-directed locking element, which space preferably is made continuous with the space mentioned in the preceding paragraph;
- the previously mentioned angle of the tangent line in the first contact zone preferably is larger than 75 degrees, and more particularly is situated between 77 and 85 degrees, and still better is approximately 80 degrees;
- the previously mentioned angle of the tangent line in the first contact zone is smaller than 90 degrees and preferably is smaller than 87 degrees and still better is smaller than 85 degrees;
- the previously mentioned angle of the tangent line in the second contact zone is more than 45 degrees and possibly more than 50 degrees, or even more than 55 degrees, and possibly is in the order of magnitude of 60 degrees; by an angle of more than 45 degrees is achieved that the panels can be joined into each other rather smoothly, even if relatively large contact surfaces are applied;
- the previously mentioned angle of the tangent line of the second contact zone is smaller than 75 degrees and still better smaller than 70 degrees, and still better smaller than 65° and still better smaller than 55° and still better is 45 to 52°, and alternatively even 45 degrees or smaller than 45 degrees; by choosing the size of this angle rather small, it may occur that the contact surfaces are somewhat more difficult to move one behind the other during the downward movement; however, then the advantage is obtained that a better resistance against vertical unlocking is created; contrary to the values listed in the previous paragraph, the inventor unexpectedly has found that even an angle smaller than 55 degrees, for example, of 45 degrees or even smaller, still remains operative and effects unexpectedly good results in the claimed configurations;
- the two contact surfaces of the second contact zone, including possible extensions thereof, seen in cross-section, extend to the left as well as to the right of the respective closing surface, wherein the closing surface is defined as a vertical plane through the upper edges of the coupled floor panels or at least the location where the floor panels come together at the top;
- the center point of the second contact zone is situated higher than the center point of the first contact zone;
- the second contact zone is a local contact zone, by which is meant that it does not extend over the entire height of the male part; more particularly, this contact zone is located with its upper end at a distance from the upper side of the floor panel and is located with its lower end at a distance above the lower end of the male part; still more particularly, it is preferred that the second contact zone, seen in height, is situated between ¼ and ¾ of the overall height of the male part, in other words, the vertical height measured between the lowest point of the male part and the upper side of the floor panel;
- the coupling parts at the first pair of edges and/or at the second pair of edges are manufactured completely in one piece from the material of the floor panel, and more particularly from a substrate forming part of the floor panel;

above said second contact zone, the distal end of the upper hook-shaped element is completely free from downwardly active support points, or anyhow at least free from support points which, in the coupled condition, define tangent lines forming an angle with the horizontal which is smaller than 45 degrees;

at the male and/or female part, inclined and/or rounded portions are formed, which are configured such that the male part, during the downward movement thereof, automatically is guided into the female part, this during a joining according to the fold-down principle and/or during a joining via a plane-parallel downward movement, the coupling parts at the first pair and/or second pair of edges are configured such that in coupled condition a so-called pretension is existing, which forces the respective floor panels at the respective edges towards each other, wherein this preferably is performed by applying overlapping contours, and wherein the pretension is the result of a deformation, either an elastic bending or an elastic compression, or a combination of both;

the coupling parts at the second pair of edges are free from hook and loop fasteners and/or adhesive connections;

the floor panel is provided with chamfers on the first and/or second pair of edges;

the floor panel has a top layer and/or decor layer which extends in one piece from the horizontal upper surface of the floor panel up to the chamfers;

the chamfers are formed by impressions;

the floor panel has a top layer with a decor;

the floor panels comprise a substrate which is or is not consisting of multiple pieces and does or does not consist of a plurality of substrate layers, wherein the substrate, or, in the case of a plurality of layers, at least one of the substrate layers consists of a material fulfilling one or more, or any combination of the following characteristics, as far as such combination is not contradictory:

synthetic material-based material, foamed or not foamed, "resilient" or hard, whether or not with plasticizer, and whether or not filled with wood-based or bamboo-based material, for example, in the form of fibers, chips, dust or sawdust, and/or filled with other substances, for example, chalk, lime, talcum, ground fillers based on stone species;

synthetic material-based material, which is foamed with fine pores, such that the majority of the synthetic material-based material comprises pores and/or gas inclusions having dimensions smaller than 1 mm, and better smaller than 0.1 mm and still better smaller than 0.01 mm;

synthetic material-based material, which is obtained by extruding synthetic material-based starting material in the form of plate material, wherein, in a preferred embodiment, this material is foamed, this in its turn preferably with fine pores which are such that the majority of the synthetic material-based material comprises pores and/or gas inclusions having dimensions smaller than 1 mm, and better smaller than 0.1 mm and still better smaller than 0.01 mm;

synthetic material-based material, which is obtained by strewing synthetic material-based material, whether or not combined with other materials, by means of a strewing process and consolidating it under the influence of pressure and possibly increased temperature in the form of plate material, wherein in a preferred embodiment the obtained material is foamed, this in its turn preferably with fine pores, which are such that the majority of the synthetic material-based material comprises pores and/or gas inclusions having dimensions smaller than 1 mm, and better smaller than 0.1 mm and still better smaller than 0.01 mm;

synthetic material consisting of, or on the basis of, or comprising one of the following materials: PP, PUR, PET, PVC, PIR or other suitable synthetic materials; synthetic material-based material with plasticizers;

wood-based material, for example, MDF, HDF, prefabricated wood panels, more particularly so-called engineered wood panels, possibly with adapted core or end strips;

the floor panel is made as one of the following kinds:

as a laminate floor panel;

as a so-called "resilient floor panel";

a "LVT" panel or "CVT panel" or comparable thereto panel on the basis of another synthetic material than vinyl;

a floor panel with a first synthetic material-based, preferably foamed, substrate layer, with thereon a preferably thinner second substrate layer of or on the basis of vinyl or another synthetic material;

as a floor panel with a hard synthetic material-based substrate.

Further characteristics will become clear from the detailed description and the enclosed claims.

Preferred, as well as deviating embodiments are described in the enclosed dependent claims.

BRIEF DESCRIPTION OF THE DRAWINGS

With the intention of better showing the characteristics of the invention, herein below, as an example without any limitative character, some preferred embodiments are described, with reference to the accompanying drawings, wherein.

DETAILED DESCRIPTION OF PREFERRED EMBODIMENTS OF THE INVENTION

Figure 1:
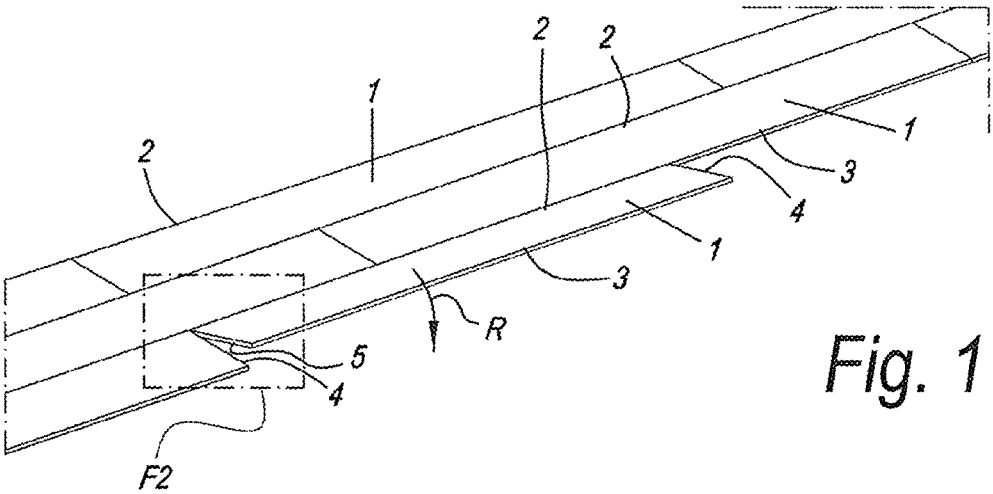
FIG. 1 schematically and in perspective represents a portion of a floor covering, which consists of floor panels according to the invention.
Figure 2:
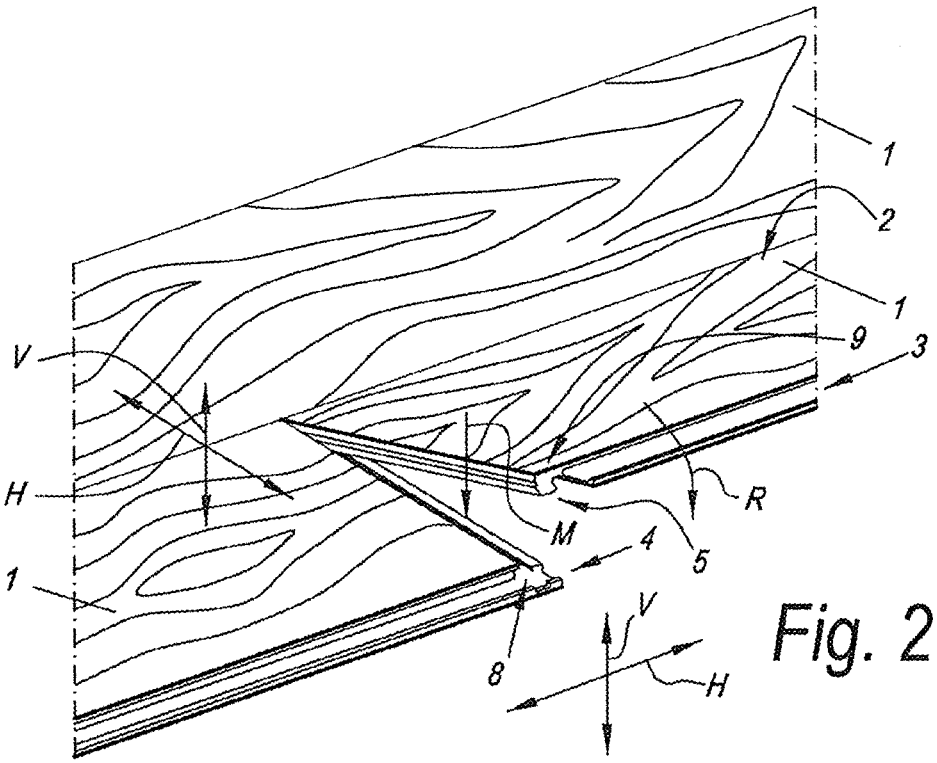
FIG. 2, at a larger scale, represents the portion indicated by F2 in FIG. 1.
Figure 3:
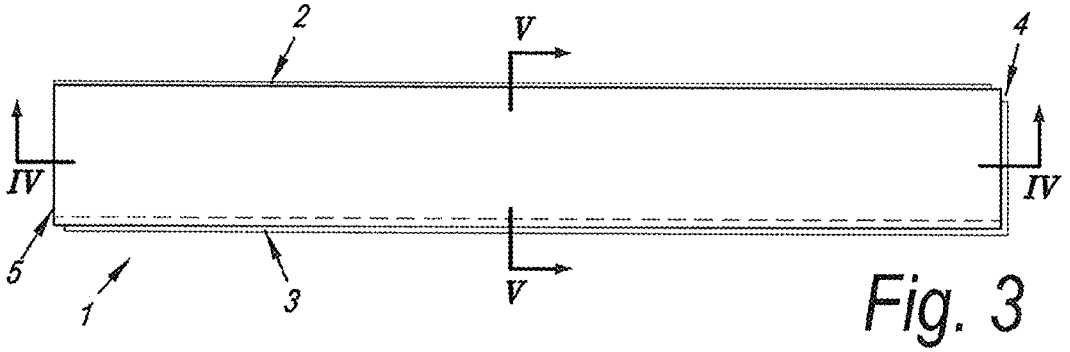
FIG. 3, in top view, represents a floor panel from the floor covering of FIGS. 1 and 2.

As represented in FIGS. 1 and 2, the invention relates to floor panels 1 for forming a floor covering, which floor panels 1 comprise a first pair of opposite edges 2-3, as well as a second pair of opposite edges 4-5.

The represented floor panels 1 are configured such at their edges that they can be mutually coupled according to the so-called fold-down principle, which is a principle known as such and which consists in that such floor panels 1 can be coupled to each other at the first pair of edges 2-3 by means of a turning movement R and can be coupled to each other at the second pair of edges 4-5 by means of a downward movement M, wherein the downward movement M is the result of the turning movement R and thus substantially is realized simultaneously. Herein, the floor panels 1 also are configured such at their edges 2-3 and 4-5 that finally a locking in vertical direction V as well as horizontal direction H is obtained, this latter perpendicular to the respective edges.

Figure 4:
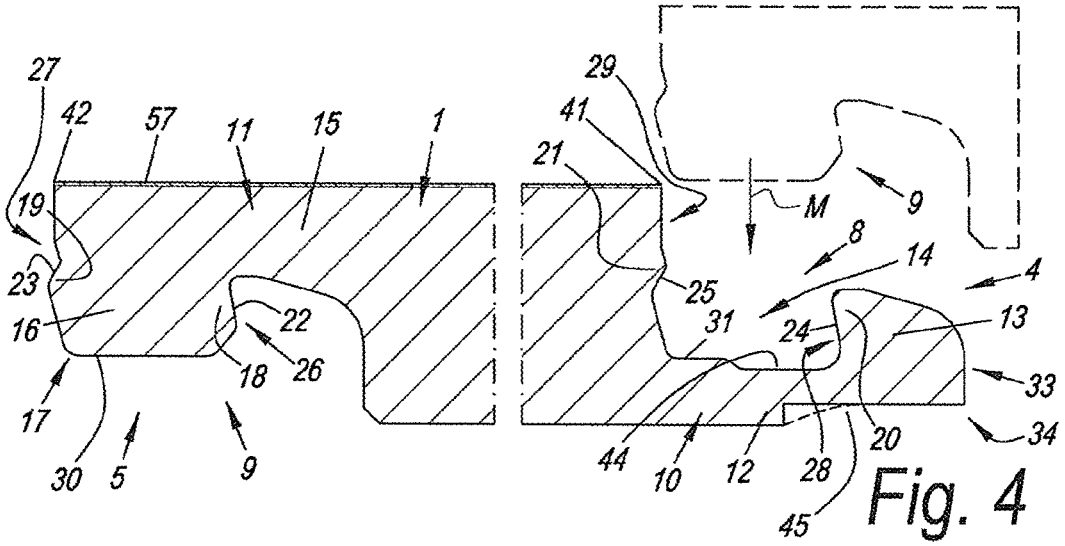
FIGS. 4 and 5, at a larger scale, represent cross-sections according to lines IV-IV and V-V, respectively, in FIG. 3.
Figure 5:
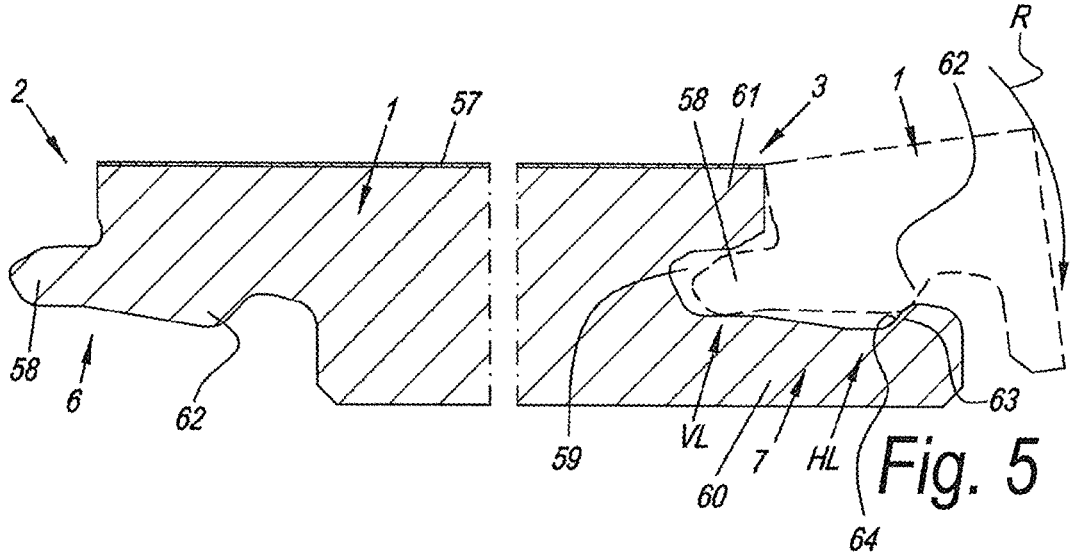
Figure 6:
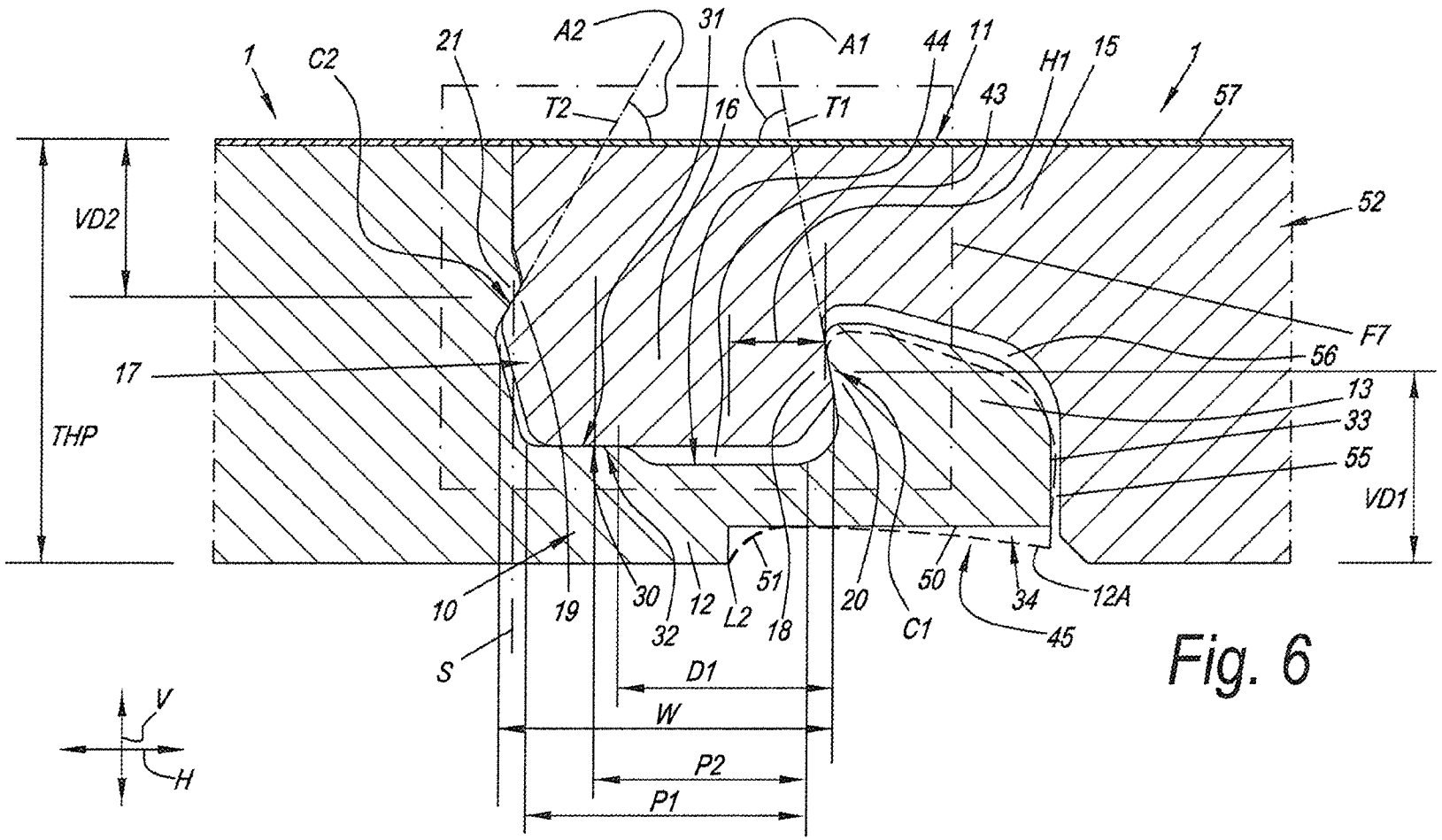
FIG. 6 represents the coupling parts, which are visible in FIG. 4, at a larger scale in coupled condition.

As represented in FIGS. 3 to 6, such floor panel 1 to this aim is provided with coupling parts 6-7 at its first pair of edges 2-3, whereas at the second pair of edges coupling parts 8-9 are provided, which coupling parts will be described in greater detail in respect to FIGS. 4 to 6.

As can be seen in FIG. 5, the coupling parts 6-7 of the first pair of edges 2-3 show at least the following basic characteristics:

- the coupling parts 6-7 comprise a horizontally active locking system HL, which, in a coupled condition of two of such floor panels 1, effects a locking in the plane of the floor panels 1 and perpendicular to the respective edges 2-3;
- the coupling parts 6-7 also comprise a vertically active locking system VL, which, in a coupled condition of two of such floor panels 1, effects a locking transverse to the plane of the floor panels, in other words, in vertical direction;
- the coupling parts 6-7 substantially are realized of the material of the floor panel 1 itself; and
- the coupling parts 6-7 are configured such that two of such floor panels 1 can be coupled to each other at these edges by means of a turning movement R.

As can be seen in FIGS. 4 and 6, the coupling parts 8-9 of the second pair of edges 4-5 show at least the following basic characteristics:

- the coupling parts 8-9 comprise a horizontally active locking system, which, in a coupled condition of two of such floor panels 1, effects a locking in the plane of the floor panels 1 and perpendicular to the respective edges 4-5;
- the coupling parts 8-9 also comprise a vertically active locking system, which, in a coupled condition of two of such floor panels 1, effects a locking transverse to the plane of the floor panels 1;
- the coupling parts 8-9 substantially are realized of the material of the floor panel 1 itself;
- the horizontally active locking system of the second pair of edges 4-5 is formed at least of an upward-directed lower hook-shaped part 10 which is situated on one of said two edges, in this case the edge 4, as well as a downward-directed upper hook-shaped part 11, which is situated on the opposite edge 5, wherein the lower hook-shaped part 10 consists of a lip 12 with an upward-directed locking element 13, which proximally thereof defines a female part 14 in the form of a recess, whereas the upper hook-shaped part 11 consists of a lip 15 with a downward-directed locking element 16 forming a male part 17;
- the coupling parts 8-9 are configured such that two of such floor panels 1 can be coupled to each other at their respective edges 4-5 by means of a downward movement M of the one floor panel in respect to the other;
- the vertically active locking system comprises vertically active locking parts 18-19-20-21, which, by means of respective contact surfaces 22-23-24-25, define at least a first contact zone C1 and a second contact zone C2, which are situated at opposite sides of the male part 17 and female part 14;
- the aforementioned vertically active locking parts comprise a first locking part 18 and a second locking part 19 at the respective opposite sides 26-27 of the male part 17, as well as a third locking part 20 and a fourth locking part 21 at the respective opposite sides 28-29 of the female part 14, in other words, at the sides located at opposite sides of the recess forming the female part;
- the first and third locking part 18, 20, respectively, in the coupled condition of two of such floor panels 1, define said first contact zone C1, while having contact surfaces 22, 24, respectively, which, in coupled condition, define at least one inclined tangent line T1;
- the second and fourth locking part 19, 21, respectively, in the coupled condition of two of such floor panels 1, define said second contact zone C2, while having contact surfaces 23, 25, respectively, which, in the coupled condition, also define at least one inclined tangent line T2;
- said male part 17 has a distal side 27 and a proximal side 26, wherein the second locking part 10 is situated at the distal side 27; and
- said two tangent lines T1-T2 are upwardly inclined towards each other from their respective contact zones C1-C2.

The embodiment of the edges 4 and 5 represented in FIGS. 4 and 6 fulfills the first aspect of the invention and thus, as represented, is characterized in that on this second pair of edges 4-5 further the following combination of features is present:

- the tangent line T1 which is defined by the first and third locking part 18, 20, respectively, is steeper in respect to the plane of the floor panel 1, thus, the global plane according to which the floor panel is extending, or, in a normal usage position thus the horizontal plane, than the tangent line T2 which is defined by the second and fourth locking part, 19, 21, respectively, or, in other words, the angle A1 of the first-mentioned tangent line T1 with the horizontal is larger than the angle A2 of the second-mentioned tangent line T2 with the horizontal;
- the difference in size between both mentioned angles A1 and A2, thus, the difference in absolute value thereof, is at least 5 degrees and preferably at least 10 degrees;
- at the male part 17, at a height lower than the second contact zone C2, a contact surface 30 is provided, which, in the coupled condition, together with a contact surface 31 at the female part 14 of the then coupled floor panel forms a support point 32 which limits the movement of the male part 17 in downward direction;
- at the distal side 33 of its distal end 34, the lower hook-shaped part 10 is free from vertically active mechanical locking parts.

It is noted that the coupling parts at the edges 2-3 and/or 4-5 preferably are configured such that in the coupled condition a so-called pretension is realized, which forces the coupled floor panels 1 towards each other, preferably with their upper edges towards and against each other. It is clear that the characteristic of the so-called pretension can be applied in all embodiments of floor panels according to the invention, as described herein above or herein below. Such pretension can be realized in various manners and preferably is based on a tension force which in coupled condition is generated by elastic bending and/or compression, wherein the retracting force created therein provides for that the floor panels are pressed towards each other. In FIG. 6, in dashed line an embodiment is represented in which such elastic bending takes place in the lower lip, wherein the bent lip is indicated by 12A. Such bending can be obtained by realizing the coupling parts 8 and 9, in reality, with somewhat overlapping contours, or in other words profile cross-sections, for example, by applying contours 8A and 9A, such as depicted in thin solid line in FIG. 7. Contours 8A and 9A represent the shape of the respective coupling parts in uncoupled and unloaded condition, with the contours placed against each other at the top. As can be seen, the contours 8A and 9A are formed such that then an overlap is existing at the height of the first and third locking part 18, 20, respectively, which overlap, in coupled condition, will result, for example, in the elastic bending of the lower lip, as indicated by 12A in FIG. 6.

Figure 7:
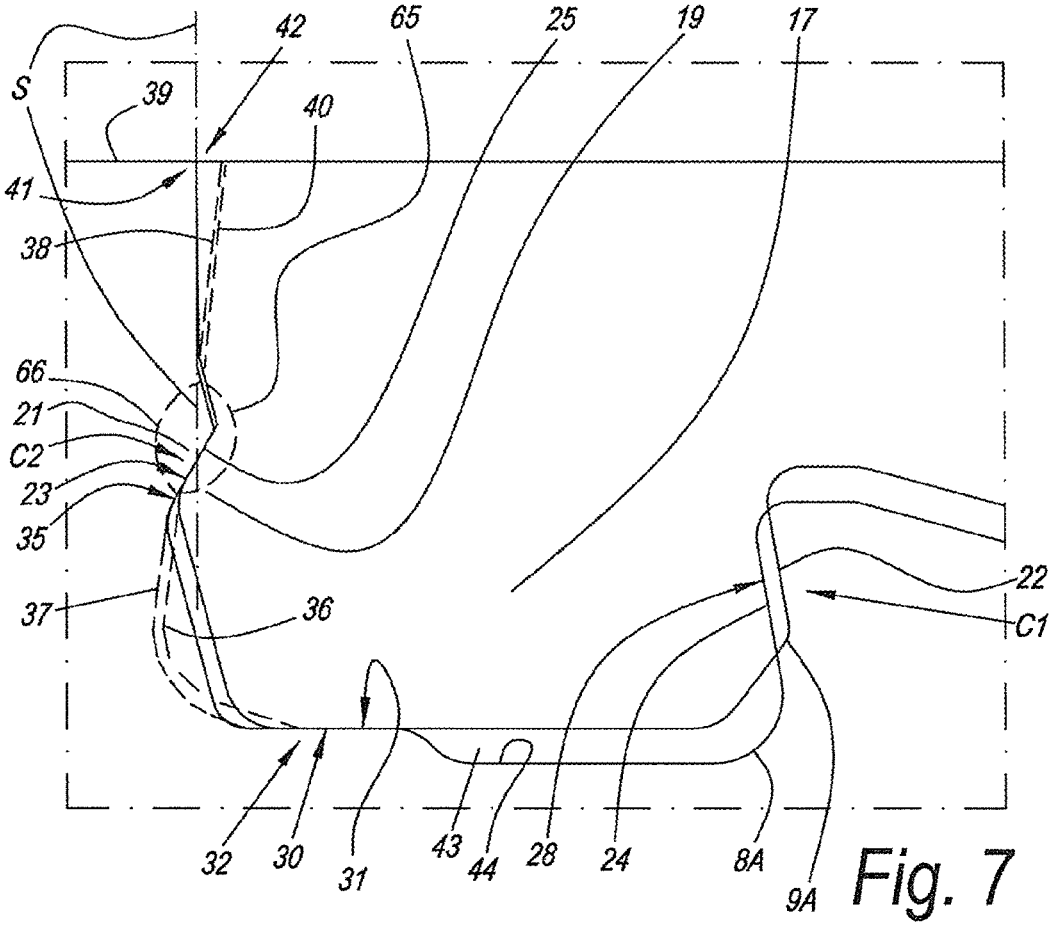
FIG. 7, at a still larger scale, represents the contours of the coupling parts from FIG. 6, however, with the original contours of the coupling parts in unloaded condition drawn over each other, such in a position in which the contours at the closing surface are positioned against each other.

In the larger view of FIG. 7, also the specific characteristics of the independent second, third and fourth aspect of the invention formulated in the introduction are illustrated schematically. Thus, these three aspects are explained herein below by means of FIG. 7.

The second and third aspect relate to alternative, examples of which are represented in FIG. 7 in dashed line, as will be explained herein below.

A floor panel according to the second aspect shows the same "basic characteristics" at the edges 2-3 and 4-5 as defined herein above. Further, the second pair of edges 4-5 moreover shows the following characteristic:

the second locking part 19, thus, of the male part 17, has a contact surface 23, which, in downward direction, by means of a bend 35, merges into a lower-situated distal surface 36, wherein this distal surface 36 in downward direction also extends further in distal direction, more particularly is made sloping in downward direction.

In other words, this means that underneath the bend 35 a portion with a surface 36 is present, which portion manifests itself in downward direction as a distal nose portion at the male part. It is clear that the bend 35 can be formed by an acute bending point as well as a rounded bending point. Intermediate surfaces can be provided as well.

The aforementioned lower-situated distal surface 36 preferably is substantially flat.

It is also preferred that said lower-situated distal surface 36 forms an angle, or, seen on average, forms an angle with the horizontal which is larger than 75 degrees and still better is larger than 80 degrees and still better is situated between 83 and 88 degrees, however, therein is inclined in a direction as in FIG. 7.

According to a preferred embodiment of the second aspect, below the contact surface 25 of the fourth locking part 21 a lower-situated proximal surface 37 is present on the female part 14, which surface, in the coupled condition of two of such floor panels, works in conjunction with the aforementioned lower-situated distal surface 36, or at least will work in conjunction therewith when the male part is moved out of the female part in upward direction. In FIG. 7, the surfaces 36 and 37 are depicted somewhat apart from each other. However, in order to fulfill the last-mentioned characteristic, these surfaces in reality in fact will coincide or approximately coincide, such that the surface 36 in the coupled condition is sitting against the surface 37, or at least is making contact therewith at a given moment during the upward movement of the male part.

A floor panel according to the third aspect also shows the same "basic characteristics" at the edges 2-3 and 4-5 as defined herein above. Further, the second pair of edges 4-5 moreover shows the following characteristic:

on the proximal side of the female part, above the second contact zone C2 a proximal surface 38 is provided, which, in respect to the recess of the female part 14, is inwardly inclined in upward direction.

In a preferred embodiment of a floor panel of the third aspect, this is further characterized in that the aforementioned proximal surface 38 substantially is flat and preferably extends up to the upper surface 39 of the floor panel 1, either up to the flat upper surface, as in FIG. 7, or up to the upper surface of a chamfer which is present at the floor panel.

According to preferred embodiments of floor panels 1 which are realized in accordance with the third aspect, such floor panel also shows one or more of the following characteristics:

said proximal surface 38 forms an angle with the horizontal which is larger than 75 degrees and better is larger than 80 degrees and still better is situated between 83 and 88 degrees;

above the contact surface of the second locking part a higher-situated distal surface 40 is present at the male part, which, in the coupled condition of two of such floor panels, works in conjunction with the aforementioned proximal surface 38, or anyway will at least work in conjunction therewith when the male part is moved out of the female part in upward direction.

In FIG. 7, the surfaces 38 and 40 are depicted somewhat apart from each other. In order to fulfill the last-mentioned characteristic, these then in reality will coincide or approximately coincide, or are lying apart from each other only so far that the surface 40, during the upward displacement of the male part, in other words, when pulling the coupling parts upwardly out of each other, comes into contact with the surface 38.

In a particularly preferred embodiment of a floor panel according to the third aspect, the male part, so to speak, forms a dovetail with a formed thereon local locking portion halfway of the distal dovetail side, either in the form of a recess, or alternatively in the form of a protrusion. This then means, for example, that, with reference to FIG. 7, the surfaces 36 and 40 are lying substantially or entirely in their mutual prolongation, whereas the second locking part 19 is situated there between. Herein, it is preferred that the surfaces 37 and 38 then also are situated approximately in their mutual prolongation and also follow the respective dovetail shape. Then, it is also preferred that the surfaces 37 and 38 in the coupled condition work in conjunction with the surfaces 36 and 40 and more particularly come into contact therewith.

A floor panel according to the fourth aspect also shows the same "basic characteristics" at the edges 2-3 and 4-5 as defined herein above. Further, the second pair of edges 4-5, as applied in the embodiment of FIGS. 4 and 6, and such as represented in greater detail in FIG. 7, at least in the embodiment in fine line, moreover shows the following characteristic:

the two contact surfaces of the second contact zone C2, including possible extensions thereof, seen in cross-section, extend to the left as well as to the right of the respective closing surface S, wherein the closing surface S is defined as a vertical plane through the upper edges 41-42 of the coupled floor panels 1, or at least the location where the floor panels 1 meet each other at the top, or thus, seen from above, visually adjoin each other.

In other words, this means that the closing surface S extends through the contact zone C2, or anyhow at least through the zone formed by the contact surfaces, inclusively the extensions thereof.

Preferably, said closing surface intersects the second contact zone, possibly including extensions thereof, halfway or approximately halfway thereof, in other words, the middle of the contact zone C2, seen in cross-section, is situated in or approximately in the closing surface. Further, it is also preferred that said intersection is located at a height which is higher than the entire first contact zone C1 is situated.

The embodiment of the second pair of edges 4-5 represented in FIGS. 4 and 6 is also in accordance with the conditions stated by the fifth aspect for these edges. As can be seen in FIGS. 4 and 6, these edges 4-5, apart from the already mentioned basic characteristics, also show the following characteristics:

- at the male part 17, at a height lower than the second contact zone C2, a contact surface 30 is provided, which, in the coupled condition, together with a contact surface 31 on the then coupled floor panel, forms a support point 32 which limits the movement of the male part in downward direction;
- the coupling parts 8-9 at the second pair of edges 4-5 also show one of the following three characteristics or any combination of two or three of these characteristics, and in the example in fact the combination of all three:
  - at the distal side 33 of its distal end 34, the lower hook-shaped part 10 is free from vertically active mechanical locking parts;
  - the contact surfaces 30-31 forming said support point 32 are situated on the lower side of the male part and on the upper side of the lip 12 of the lower hook-shaped part 10, respectively, wherein in coupled condition, distally from this support point 32 a space 43 remains present between the lower side of the male part and the upper side of said lip, this preferably underneath the entire portion of the male part situated distally from said support point 32, wherein this space 43, as represented, preferably is formed in that a portion 44 of the upper side of the lip 12 is situated deeper than the support point, and/or wherein this space 43, seen in a cross-section of the respective edge, preferably extends over a distance D1 which is at least ⅓ of the width W of the male part;
  - at the lower side of the lip 12 of the lower hook-shaped part 10, a recess 45 is present, which extends up to the distal end of the lip and which allows a bending of the lip in downward direction.

Figure 8:
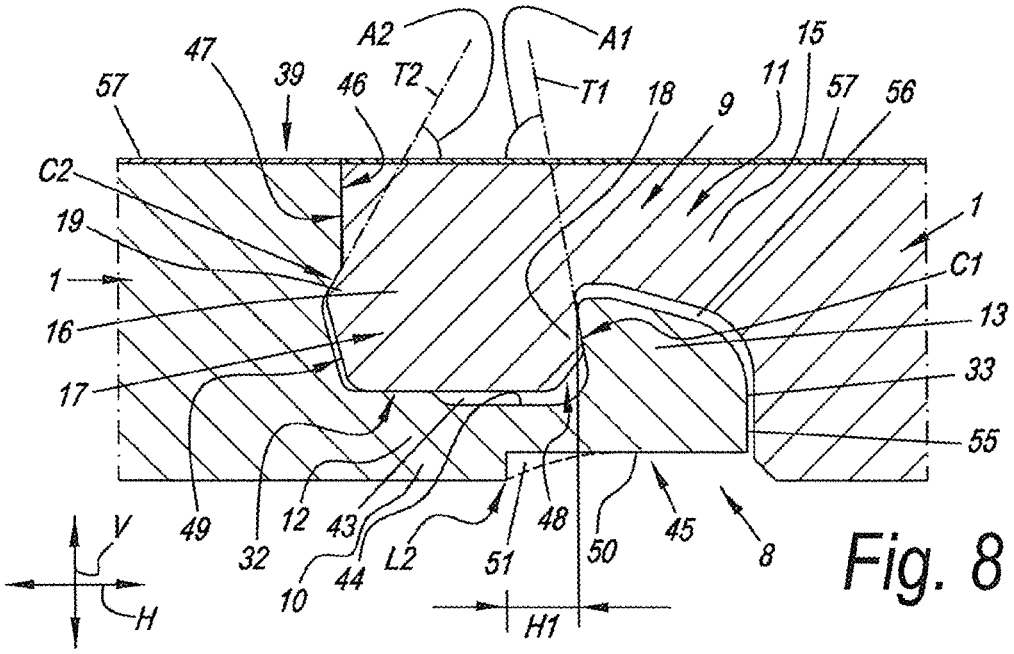
FIGS. 8 to 10 represent three further embodiments of the invention.

FIG. 8 represents a variant of the embodiment of FIG. 6, wherein this variant applies the characteristics of the first and fifth aspect, however, not the characteristics of the second, third and fourth aspect.

Figure 9:
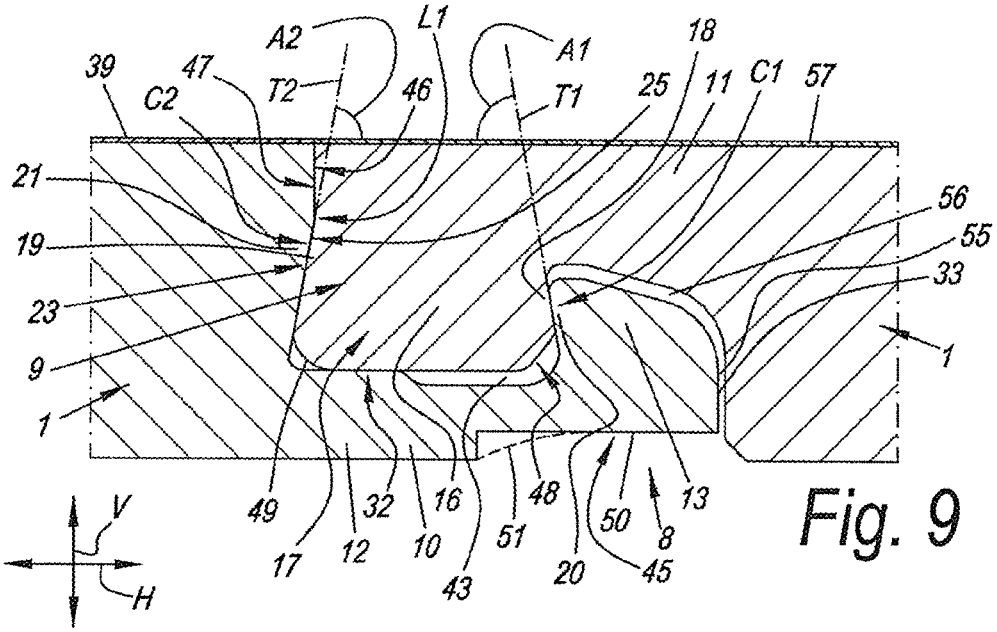

In FIG. 9, a variant of the second pair of edges is shown, with which, by the application thereof, a floor panel 1 can be realized which fulfills the sixth aspect of the invention.

It is clear that the edges 4-5 represented in FIG. 9 comprise the basic characteristics already mentioned before. As can be seen as well, these edges also show the following combination of characteristics required according to the sixth aspect:

- the contact surfaces 23-25 of the second and fourth locking part, and possible extensions of these surfaces, are made flat or substantially flat;
- the contact surfaces 23-25 of the second and fourth locking part, and more particularly the tangent line T2 defined thereby, form an angle A2 with the horizontal which is larger than 70 degrees, and still better is larger than 75 degrees, however, preferably is smaller than 85 degrees;
- the contact surfaces 23-25 of the second and fourth locking part, and possible extensions of these surfaces, in upward direction each terminate at locations L1 which are situated lower than the upper surface 39 of the floor panels, wherein these locations do coincide or do not coincide with each other;
- starting from the upper ends of the contact surfaces 23-25 of the second and fourth locking part, and from possible extensions of these surfaces, up to the upper surface 39 of the floor panel, lateral edge portions 46-47 are formed, which extend more straight upward than said contact surfaces 23-25 and preferably are vertical or approximately vertical;
- at the lower edges of the male part, guiding surfaces 48-49, such as inclined parts or rounded parts, are present, which are configured such that the male part during the downward movement thereof automatically is guided into the female part.

As represented in FIG. 9, a floor panel according to the sixth aspect, in a preferred embodiment thereof, is also characterized in that the upward-directed locking element 13, which at the same time is configured such that it also functions as said third locking element 20, is elastically tiltable, preferably assisted by the presence of a recess 45 on the lower side of the lip of the lower hook-shaped part 10.

The embodiment represented in FIGS. 1 to 6 also forms an example of the seventh and eighth aspect of the invention. This seventh and eighth aspect, defined in the introduction, and in particular the specific characteristics required therein at the second pair of edges, thus will be explained in greater detail with reference to FIG. 6.

Regarding the seventh aspect, at the second pair of edges, apart from the already mentioned basic characteristics, the following characteristic is present as well:

- the lip 12 of the lower hook-shaped part 10, seen in a cross-section transverse to the respective edge, is characterized by a first longitudinal portion P1, being the portion extending from the proximal end of the lower hook-shaped part 10 up to the location where the upward-directed locking element 13 is starting, and by a second longitudinal portion P2, which is defined as being the most distal 75% of the first longitudinal portion P1, wherein the lip is reduced in thickness by at least 5%, and better at least 10% and still better at least 30% inside the aforementioned second longitudinal portion P2, such while preferably the distal side 33 of the distal end 34 of the lower hook-shaped part 10 is free from vertically active locking parts.

In a preferred embodiment of the seventh aspect, the floor panel further is characterized in that it also shows one of the following characteristics:

- the thickness reduction is realized at least by means of providing a deeper-situated portion, namely the already mentioned portion 44, in the upper side of the lip 12 of the lower hook-shaped part 10;
- the thickness reduction is realized at least by means of providing a recess 45 at the lower side of the lip 12 of the lower hook-shaped part 10;

the thickness reduction is realized at least by means of both measures mentioned in the preceding paragraphs, wherein preferably in cross-section and in a direction perpendicular to the respective edge there is an overlap between the aforementioned deeper-situated portion 44 and said recess 45.

Further, it is also preferred that both angles A1 and A2, such as also applied in the example, are larger than 50 degrees.

It is noted that the eighth aspect was also applied in all embodiments of FIGS. 7 to 10. The variant of FIG. 7, which makes use of the surfaces 36 and 37 represented in dashed line, moreover shows the characteristic mentioned in the introduction that said female part 14 and male part 17, at both sides, comprises portions which together are configured as dovetail portions, which preferably are situated at least partially opposite to each other, in other words, extend at least partially over the same height interval.

Referring to FIG. 6 again, it is clear that this embodiment also shows the specific combination of characteristics which is required according to the eighth aspect, namely:

at the lower side of the lower hook-shaped part 10, a recess 45 is present which extends from a certain location L2 at the lower side up to the end of the lower hook-shaped part 10; and seen in cross-section, said location L2 is situated proximally from the upward-directed locking element 13, and preferably at a horizontal distance H1 therefrom, which is more than 1/10 of the overall thickness of the floor panel 1.

In a preferred embodiment of the eighth aspect, the floor panel 1 preferably, as represented, is also characterized in that the recess 45 consists of a recessed portion 50, which is recessed in respect to the actual lower side of the floor panel, and a transition portion 51, which is situated between the actual lower side and the recessed portion 50 and which provides for a gradual transition.

Figure 10:
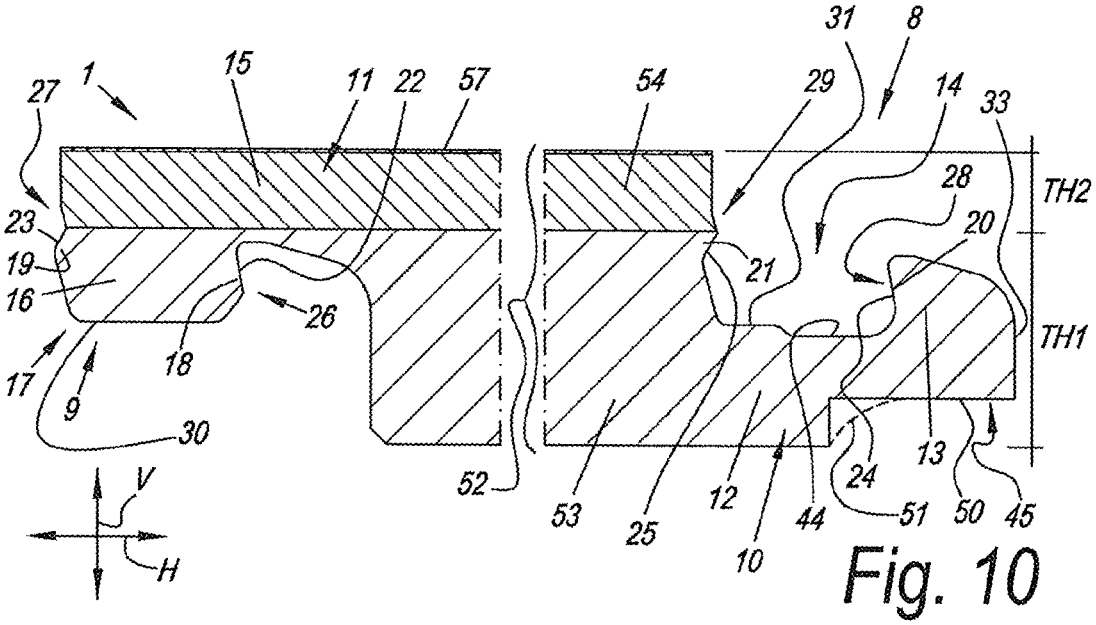

In FIG. 10, a floor panel 1 is represented which is realized in accordance with the ninth aspect of the invention. At the edges 2-3 and 4-5, the floor panel shows the same "basic characteristics" as already defined herein above. Moreover, the floor panel 1 is characterized in that it comprises a composed substrate 52, which consists at least of two substrate layers 53-54 each having a well-defined thickness TH1, TH2, respectively, namely a first synthetic material-based substrate layer 53 and a second substrate layer 54 preferably situated directly there above, which second substrate layer 54 has a thickness TH2 of at least 0.5 mm, preferably at least 1 mm; wherein this composed substrate also shows one of the following characteristics or any combination of these characteristics:

the density of the first substrate layer 53 is different from the density of the second substrate layer 54, and preferably the second substrate layer 54 has a higher density than the first substrate layer 53;

the first substrate layer 53 is foamed, and preferably is of the closed cell type and still more preferably of the so-called hard foam type, and preferably the second substrate layer 54 is not foamed or is less foamed than the first substrate layer 53;

the first substrate layer 53 is extruded in a plate shape or is formed by means of a strewing process and consolidation of the strewn material to a plate;

the second substrate layer 54 consists of an extruded layer or of a layer which is formed by means of a strewing process and consolidation of the strewn material.

the two substrate layers 53-54 are glued to each other or, alternatively, are consolidated in the same production process; this latter, for example, by mutual direct adhesion between the materials of the substrates, or, for example, also by forming them from a single composed mass with at least two layers;

at least one of the aforementioned contact zones C1, C2, and preferably both, are situated at least partially and preferably entirely in the first substrate layer 53, as is also clearly shown in FIG. 10.

Also, all combinations of two, three, four, five or all six of the characteristics listed herein above are possible according to the ninth aspect, wherein all mathematically possible combinations come into consideration, without thereby excluding certain combinations.

According to preferred embodiments of a floor panel according to the ninth aspect, it further comprises one or more of the features listed herein below, wherein also all combinations are possible, as far as they do not comprise contradictory characteristics:

said first substrate layer comprises at least a thermoplastic material;

said first substrate layer is made at least on the basis of polyvinyl chloride, polyethylene, polyurethane, polypropylene or PIR, or a combination of the aforementioned;

said first substrate layer is a filled synthetic material composite, wherein this filling preferably consists of one or a combination of the following materials: bamboo, cork and/or wood, and more particularly one or a combination of the aforementioned materials in the form of chips and/or fibers and/or dust or flour, such as sawdust;

said first substrate layer is foamed;

said first substrate layer is of the closed cell type;

said first substrate layer comprises one or more plasticizers;

said first substrate layer comprises fillers, such as chalk and/or lime and/or talcum;

said first substrate layer is provided with at least one reinforcement layer, preferably of glass fiber or the like;

said first substrate layer has a thickness of at least 3 mm, preferably at least 4 mm, and still more preferably at least 5 mm;

said first and/or second substrate layer is made water-resistant;

said second substrate layer is synthetic material-based;

said second substrate layer comprises at least a thermoplastic material, which preferably is of the soft type;

said second substrate layer is made at least on the basis of vinyl, such as polyvinyl chloride, more particularly soft polyvinyl chloride, polyethylene, more particularly soft polyethylene, polyurethane, polypropylene, PIR or a combination of the aforementioned;

said second substrate layer substantially consists of one or a combination of the following materials: wood veneer, rubber, linoleum, a paper-based or foil-based laminate sheet, or alternatively any material, more particularly cork, bamboo or wood veneer, which is encased by vinyl or resin;

said second substrate layer comprises one or more plasticizers;

said second substrate layers comprises fillers, such as chalk and/or lime;

said second substrate layer is provided with at least one reinforcement layer, preferably of glass fiber or the like;

the floor panel comprises a backing layer, which preferably is situated directly underneath the first substrate layer, which backing layer, for example, is made on the basis of one or more of the following materials: cork, rubber and/or a soft foamed layer;

the floor panel comprises a top layer, whether or not consisting of a plurality of layers, which top layer preferably is situated directly above the second substrate layer, and/or the second substrate layer is provided with a backing layer at the underside of this second substrate layer;

top layer comprises at least a decorative layer, preferably in the form of a print, preferably provided on a foil or film;

said top layer comprises at least a translucent or transparent wear layer and/or is provided with hard particles for increasing the wear resistance, such as corundum;

the floor panel has an overall thickness which is smaller than 10 mm, still better in the order of magnitude of 8 mm or possibly thinner;

said first substrate layer is foamed gradually, wherein the degree of foaming increases in downward or in upward direction.

Figure 11:
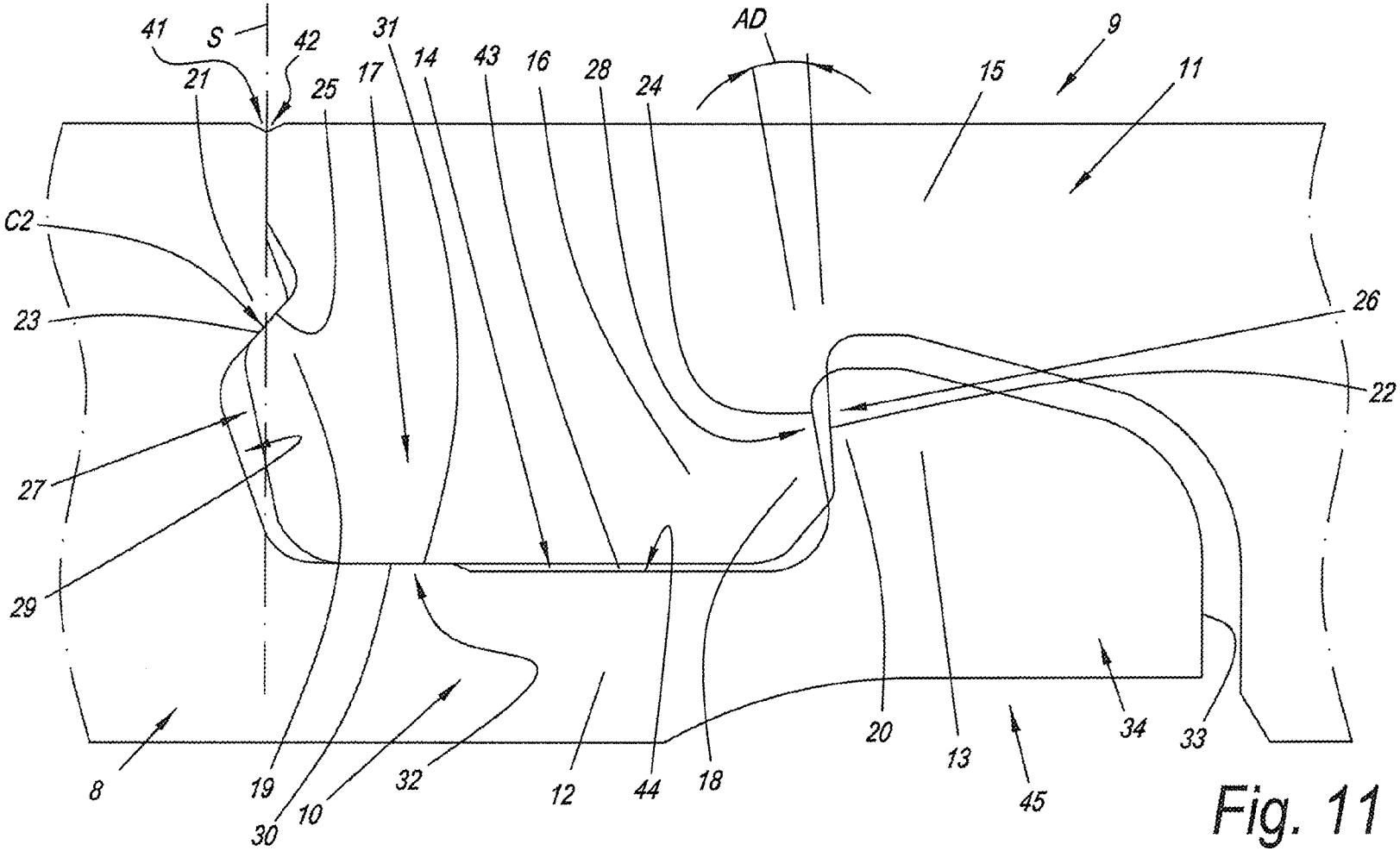
FIGS. 11 and 12 represent another embodiment of the invention.
Figure 12:
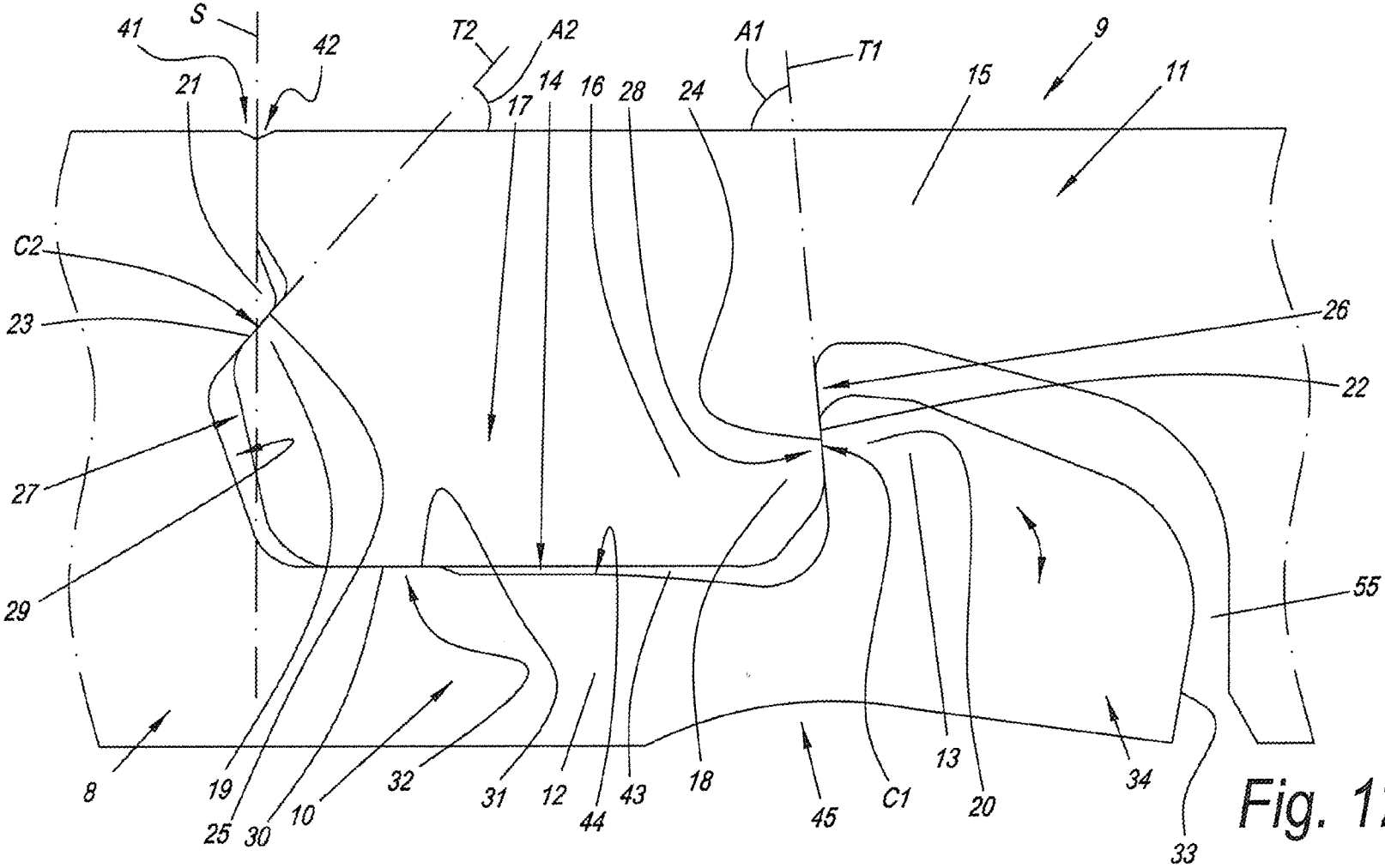

FIGS. 11 and 12 represent the second pair of edges of floor panels which fulfill the tenth aspect of the invention. In FIG. 11, the contours of the coupling parts 8-9 are represented, wherein these contours simply are represented with the upper edges against each other, however, in not-coupled condition. FIG. 12 represents the same edges, however, in coupled condition.

As mentioned in the introduction, the tenth aspect provides a floor panel for forming a floor covering, wherein this floor panel 1 comprises a first pair of opposite edges 2-3, as well as a second pair of opposite edges 4-5, analogous to the illustration in FIGS. 1 and 2.

Also, according to the tenth aspect, the first pair of opposite edges 2-3 comprises coupling parts 6-7, which, for example, analogous to FIG. 5, allow that two of such floor panels 1 mutually can be coupled to each other, and wherein these coupling parts 6-7 show the following characteristics:

the coupling parts 6-7 comprise a horizontally active locking system, which, in a coupled condition of two of such floor panels 1, effects a locking in the plane of the floor panels and perpendicular to the respective edges 2-3;

the coupling parts 6-7 also comprise a vertically active locking system, which, in a coupled condition of two of such floor panels, effects a locking transverse to the plane of the floor panels;

the coupling parts 6-7 substantially are realized from the material of the floor panel itself; and the coupling parts 6-7 are configured such that two of such panels can be coupled to each other at these edges by means of a turning movement.

Also, according to the tenth aspect, the second pair of opposite edges 4-5 also comprises coupling parts 8-9 on both edges, which allow that two of such floor panels 1 mutually can be coupled to each other, and wherein these coupling parts 8-9 show the following characteristics:

the coupling parts 8-9 comprise a horizontally active locking system, which, in a coupled condition of two of such floor panels 1, effects a locking in the plane of the floor panels 1 and perpendicular to the respective edges 4-5;

the coupling parts 8-9 also comprise a vertically active locking system, which, in a coupled condition of two of such floor panels 1, effects a locking transverse to the plane of the floor panels 1;

the coupling parts 8-9 substantially are realized from the material of the floor panel 1 itself;

the horizontally active locking system of the second pair of edges 4-5 is formed at least of an upward-directed lower hook-shaped part 10 which is situated on one of said two edges 4, as well as a downward-directed upper hook-shaped part 11, which is situated on the opposite edge 5, wherein the lower hook-shaped part 10 consists of a lip 12 with an upward-directed locking element 13, which proximally thereof defines a female part 14 in the form of a recess, whereas the upper hook-shaped part 11 consists of a lip 15 with a downward-directed locking element 16 forming a male part 17;

the coupling parts 8-9 are configured such that two of such floor panels 1 can be coupled to each other at their respective edges 4-5 by means of a downward movement of the one floor panel in respect to the other;

the vertically active locking system comprises vertically active locking parts 18-19-20-21, which, by means of respective contact surfaces 22-23-24-25, define at least a first contact zone C1 and a second contact zone C2, which are situated at opposite sides of the male part 17 and female part 14;

the aforementioned vertically active locking parts comprise a first locking part 18 and a second locking part 19 at the respective opposite sides 26-27 of the male part 17, as well as a third locking part 20 and a fourth locking part 21 at the respective opposite sides 28-29 of the female part 14;

the first and third locking part 18, 20, respectively, in the coupled condition of two of such floor panels 1, define said first contact zone C1, while having contact surfaces 22 and 24, which, in coupled condition, define at least one inclined tangent line T1;

the second and fourth locking part 19, 21, respectively, in the coupled condition of two of such floor panels 1, define said second contact zone C2, while having contact surfaces 23 and 25, which, in the coupled condition, also define at least one inclined tangent line T2;

said male part 17 has a distal side 27 and a proximal side 26, wherein the second locking part 19 is situated at the distal side 27; and said two tangent lines T1-T2 are upwardly inclined towards each other from their respective contact zones C1-C2.

According to the tenth aspect, the floor panel is characterized in that the upward-directed locking element 13, the downward-directed locking element 16 and the pertaining contact surfaces of the first contact zone C1 are configured such that the upward-directed locking element 13 with its pertaining contact surface, in the coupled condition, adopts a somewhat tilted position in respect to the position adopted by this contact surface in the free condition; and that both contact surfaces of the first contact zone, in the not coupled condition, are oriented mutually deviating in such a manner that in the coupled condition mutually a less deviating or not deviating orientation is obtained. This is clearly illustrated in FIGS. 11 and 12. In FIG. 11 is clearly shown that the respective contact surfaces in free condition have a mutually deviating orientation, whereas in the coupled condition of FIG. 12 they have a corresponding orientation and thus coincide with each other.

According to FIG. 11, the aforementioned contact surfaces, when for their free condition the contours thereof are presented over each other, are inclined towards each other in downward direction, or, in other words, in downward direction a decreasing overlap is provided.

As represented, it is preferred that said contact surfaces substantially are flat and that, when for their free condition the contours of the coupling parts are presented over each other, the respective contact surfaces show an angle difference AD of 2 to 10 degrees.

According to another preferred characteristic of the tenth aspect, the tangent line T2, which is determined by the aforementioned second contact zone C2, forms an angle A2 with the horizontal which is smaller than 60°, and still better smaller than 55°, and still better is 45 to 52 degrees, or alternatively is 45 degrees, and also alternatively is even less than 45 degrees. Such smaller angle provides for a better engagement. In combination with the main characteristic of the tenth aspect, this moreover offers a synergetic effect. The inventor in fact has found that in such couplings, which are critical because joining them must not be too difficult, but at the same time also must be able to offer sufficient locking, the combination of certain characteristics sometimes offers unexpectedly good results.

The use of such values for the angle A2 can also be applied in combination with the other aspects of the invention, as far as not being contradictory.

It is clear that the locking element 13, or at least the respective contact surface thereof, according to the tenth aspect must be tiltable. This tiltability may be realized in any manner Preferably, to this aim a recess 45 is provided at the lower side of the floor panel, however, other techniques are not excluded. The tiltability can also be achieved, for example, as a result of elasticity in the material.

Figure 13:
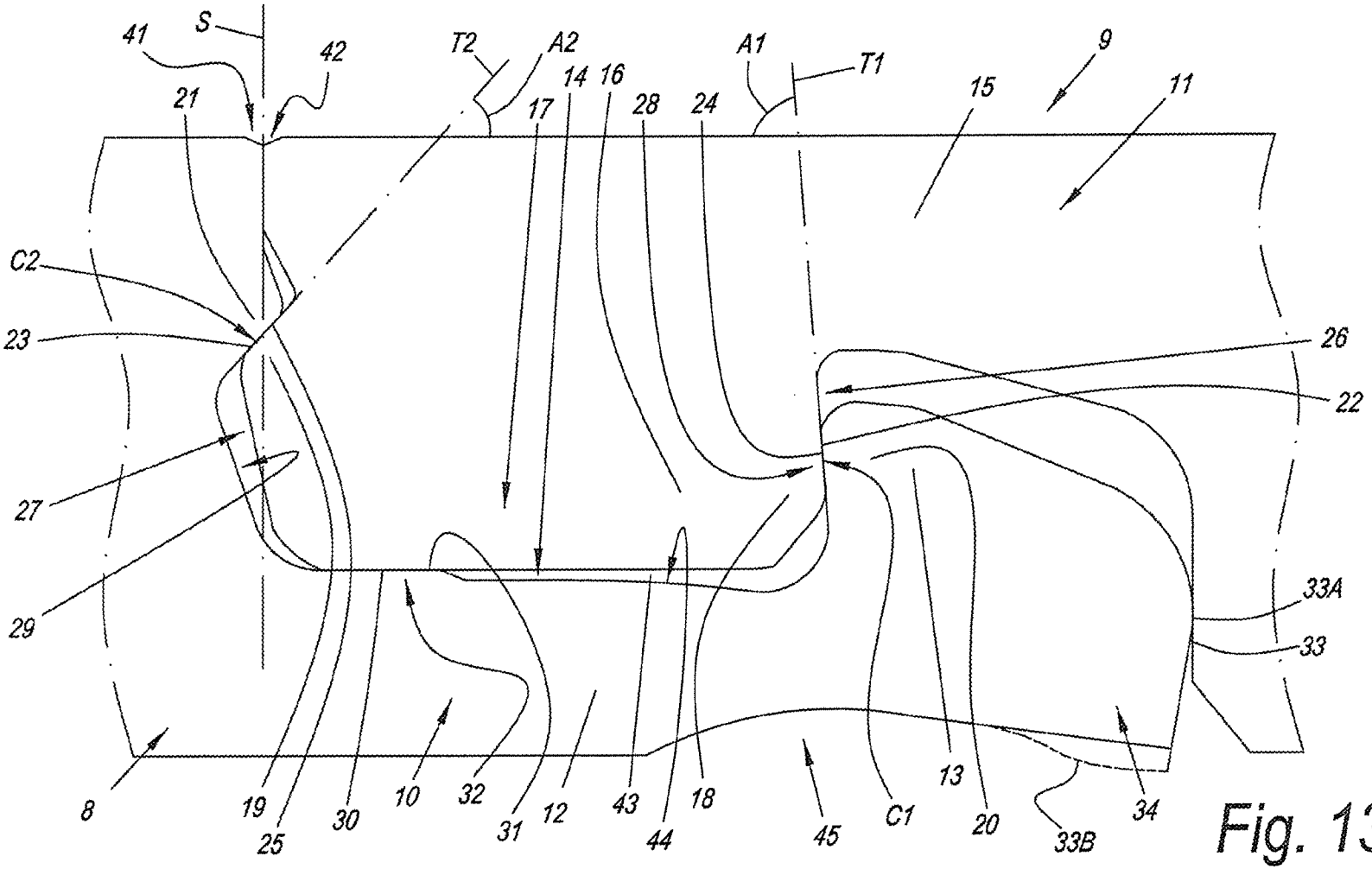
FIGS. 13 to 17 represent other different variants of the invention.
Figure 14:
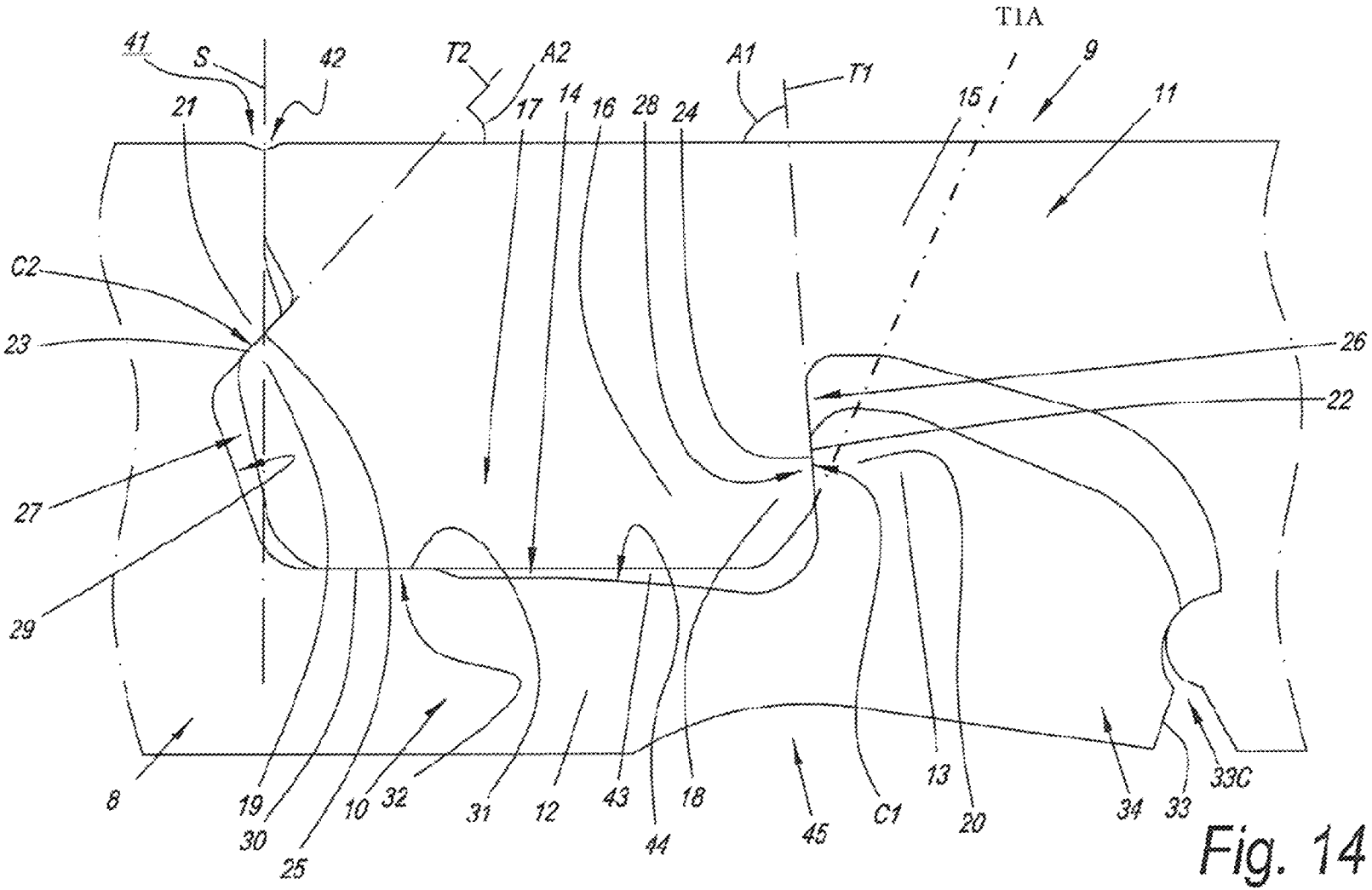

The tenth aspect generally does not comprise any requirements in respect to the fact whether the lower hook-shaped part 10 at the distal side 33 is free from vertically active mechanical locking parts or not. Thus, there are three different possibilities, which each are interesting. According to a first possibility, for which the embodiment of FIGS. 11 and 12 is an example, the distal side 33 in the coupled condition is free from any contact with the coupled floor panel. This embodiment allows a very smooth joining. According to a second possibility, for which the embodiment of FIG. 13 is an example, at the height of the distal side 33 and the adjacent side of the coupled floor panel there is a mutual contact 33A, in that the respective floor panels there become seated against each other in a fitting or clamping manner Herein, possibly an additional pressing on can be provided by means of a support portion 33B, which, in the coupled condition, presses onto the underlying floor and in this manner generates a force with which the locking element 13 is pressed on in upward direction, and/or with which it is at least counteracted that the locking element 13 laterally tilts in outward direction. According to this second possibility, there is no vertical active mechanic locking, however, in fact a clamping due to friction may be created. The advantage of the second possibility consists in that the tiltable locking element more or less gets stuck, whereby in mounted condition a higher resistance will have to be overcome at the first contact zone in order to pull the floor panels vertically out of each other. According to a third possibility, of which FIG. 14 shows an example, at the height of the distal side 33 and the adjacent floor panel also vertically active locking parts can be provided, which engage one behind the other and which effect a mechanical locking 33C. In this manner, an extra locking is obtained.

Figure 15:
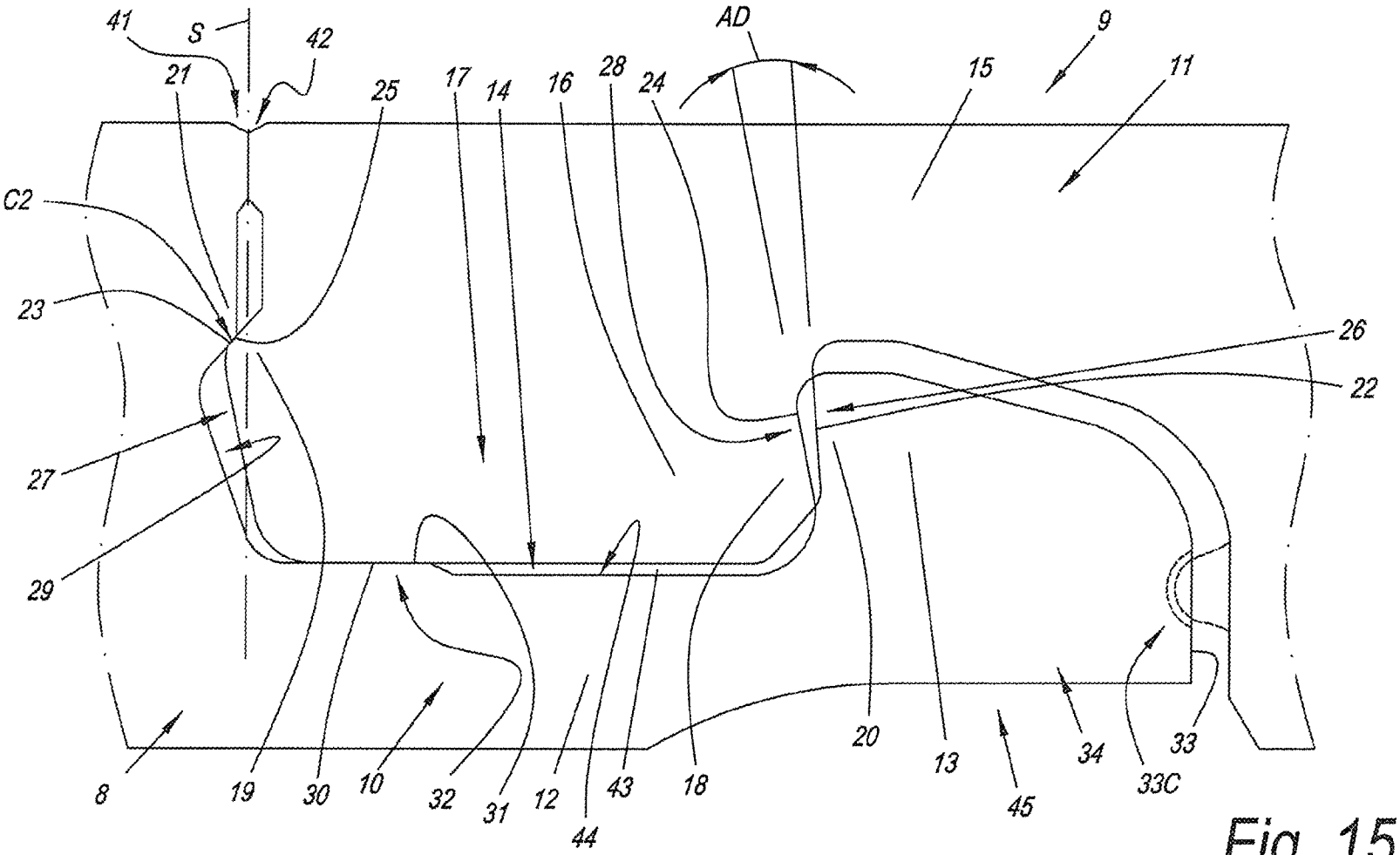
Figure 16:
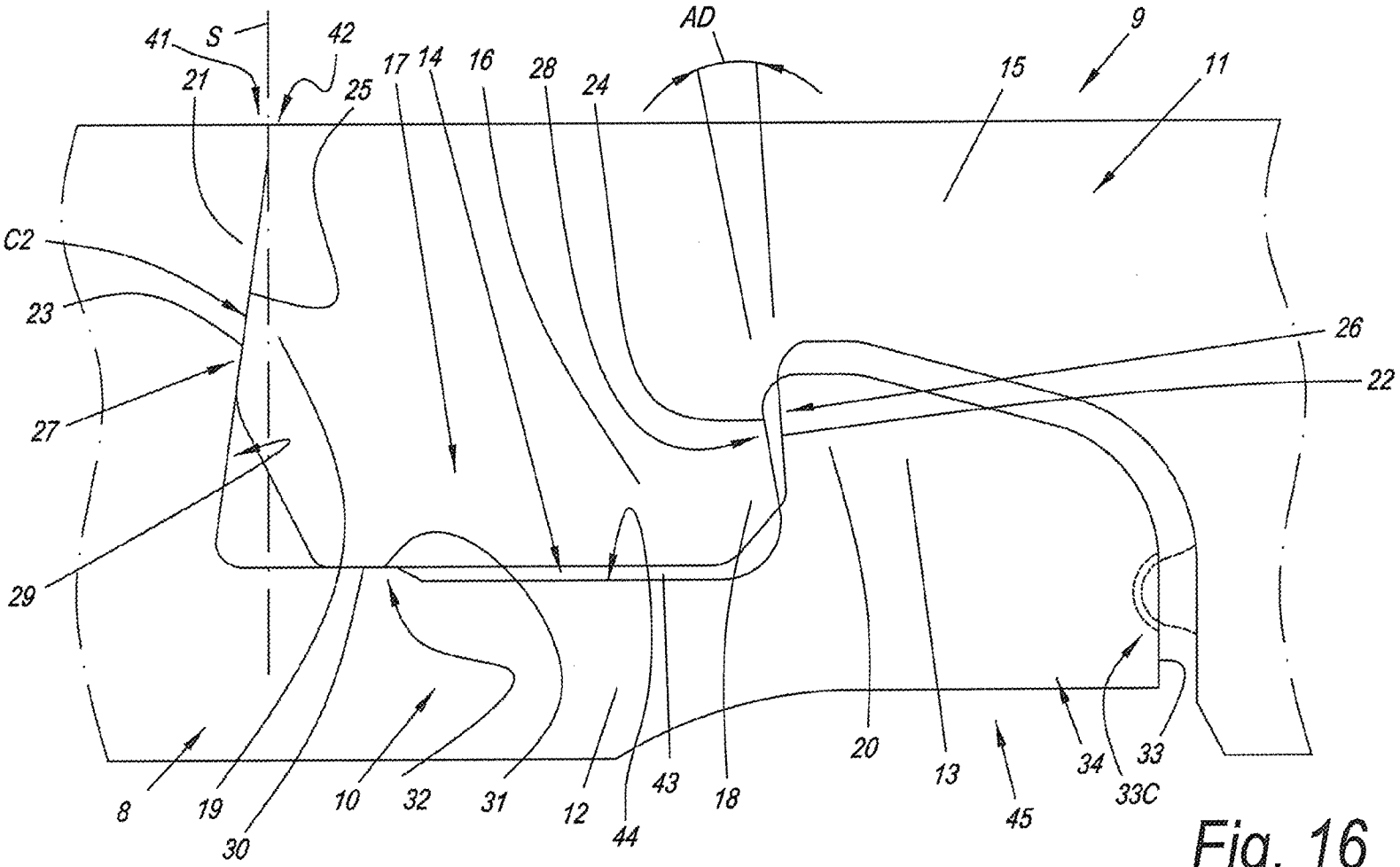
Figure 17:
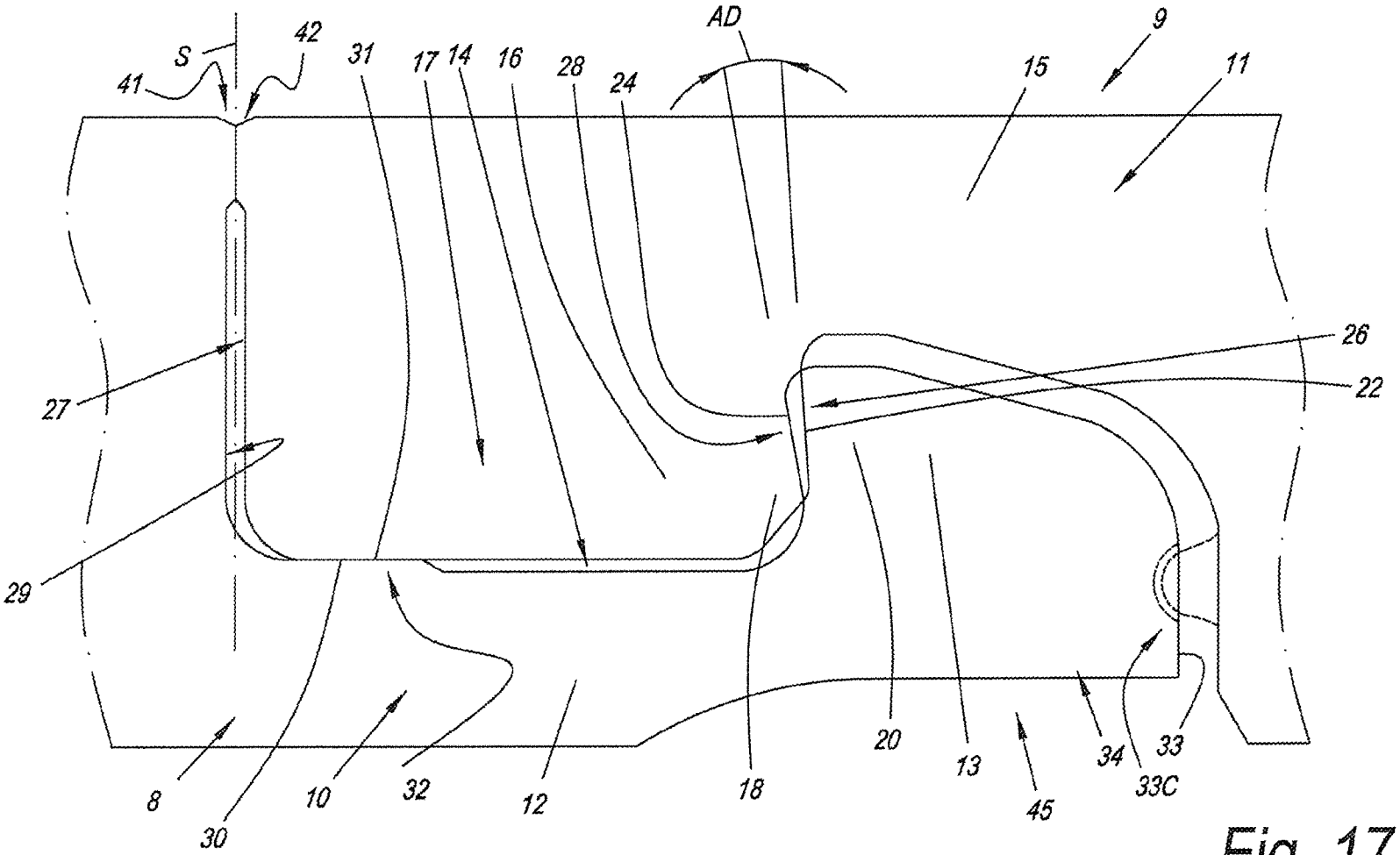

It is noted that the characterizing part of the tenth aspect can also be applied in a broader sense. Thus, the invention provides for a deviating aspect, according to which the characterizing part of the tenth aspect in any so-called push-lock or fold-down coupling is applied, thus, with the only requirement that at the first contact zone inward-directed contact surfaces are present, which have to fulfill the characterizing part of the tenth aspect, whereas at the location where usually the second contact zone is present, then a vertical locking is or is not present, wherein in the case of a locking this can be of any kind. FIGS. 15 and 16 represent other examples with a locking at the height of the second contact zone. FIG. 17 represents an example where the aforementioned second contact zone is replaced by a zone where no vertical locking is present. FIGS. 15 to 17 also illustrate that it is always possible, if desired, to provide an additional vertically active mechanical locking 33C at the height of the distal side 33.

The floor panels of the invention may also comprise one or more of the herein below listed features. These features may be mutually combined at choice, wherein all possible combinations come into consideration, as far as they do not comprise contradictory characteristics and thus are feasible. Also, any of these features or any feasible combination of features can be applied to a floor panel of any of the aforementioned aspects or combination of aspects, of course also as far as such combination does not comprise contradictory characteristics. The intended features are the following:

- the coupling parts 6-7 and 8-9 are realized such at the floor panel 1 that a plurality of such floor panels 1 can be installed according to the fold-down principle;
- the floor panel 1 is oblong rectangular and the first pair of opposite edges 2-3 forms the long sides of the floor panel 1, whereas the second pair of opposite edges 4-5 forms the short sides of the floor panel 1;
- the coupling parts 8-9 at the second pair of edges 4-5 can be joined into each other by means of a downward snap movement;
- the coupling parts at the first and/or second pair of edges are made substantially as profiled parts in the material of the floor panel, preferably substantially or entirely by means of a machining treatment, preferably by means of one or more milling treatments, for example, with milling cutters which are active under different operative angles, and still more particularly milling cutters of which the rotation axis during use is located external to the floor panel;
- the coupling parts at the first and/or second pair of edges are made as millable profiled parts, which can be milled by means of milling cutters with a rotational axis which during milling is situated external to the floor panels;
- the aforementioned male part 17 is or is not split; preferably, the male part is a solid part, which thus, for example, as in FIGS. 4 and 6, is solid between the sides 26 and 27 and then is not split, which provides a massive support for the locking parts 18 and 19;
- according to an alternative, the male part is not solid and consists one or more cavities or recesses, wherein then it can, for example, be split, wherein such presence of cavities or recesses offers the advantage that the locking parts 18 and/or 19 can be somewhat more elastically movable; then the one or the other possibility can be opted for, in function of the applied material and/or in function of the desired locking effect;
- at the second pair of edges, only one male part is applied, whether or not split; at the aforementioned male part 17, only one vertically active locking part 19 is present, which, in coupled condition, defines a tangent line T2 of less than 70 degrees with the horizontal, whereas other, one or more, vertically active locking parts may be present indeed, in other words, one or more locking parts, which, in the coupled condition, only define a tangent line or tangent lines T1, which forms or forms an angle of 70 degrees or more with the horizontal;

the contact surface of the second and/or fourth locking part 19, 21, respectively, and preferably the contact surfaces of both, is, are, respectively, made flat;

the contact surfaces of the second and/or fourth locking part, and preferably of both, is, are, respectively, made curved; herein, the contact surface of the fourth locking part preferably is convex, whereas the contact surface of the second locking part is flat or curved, and preferably is concave;

the lower hook-shaped part 10 and more particularly the lip 12 thereof is resiliently bendable and/or deformable;

at the lower side of the lip, a recess 45 is present, preferably configured such that the upward-directed locking element 13 is elastically tiltable;

in coupled condition, a downward-directed support point 32 is provided at the male part 17;

underneath the male part, a space 43 is present;

the recess 45 and/or support point 32 and/or space 43 mentioned in the preceding paragraphs are configured such as already explained with reference to the drawings; in coupled condition, a space 55 is present behind the distal end of the lower hook-shaped part 10;

in coupled condition, a space 56 is present above the upward-directed locking element 13, which space preferably is made continuous with the space 55 mentioned in the preceding paragraph;

the previously mentioned angle A1 preferably is larger than 75 degrees, and more particularly is situated between 77 and 85 degrees, and still better is approximately 80 degrees;

the previously mentioned angle A1 is smaller than 90 degrees and preferably is smaller than 87 degrees and still better is smaller than 85 degrees;

the previously mentioned angle A2 is more than 45 degrees;

the previously mentioned angle A2 is smaller than 75 degrees and still better is smaller than 70 degrees, and still better smaller than 65°, and still better smaller than 55° and still better is 45 to 52°, and alternatively even 45 degrees or, according to still another alternative, is smaller than 45 degrees;

the two contact surfaces of the second contact zone C2, including possible extensions thereof, seen in cross-section, extend to the left as well as to the right of the respective closing surface S, wherein the closing surface S is defined as a vertical plane through the upper edges 41-42 of the coupled floor panels or at least the location where the floor panels come together at the top;

the center point of the second contact zone C2 is situated higher than the center point of the first contact zone C1;

the coupling parts at the first pair of edges and/or at the second pair of edges are manufactured completely in one piece from the material of the floor panel 1, and more particularly from a substrate forming part of the floor panel;

above said second contact zone C2, the distal end of the upper hook-shaped element is completely free from downwardly active support points, or anyhow at least free from support points which, in the coupled condition, define tangent lines forming an angle with the horizontal which is smaller than 45 degrees;

at the male and/or female part, inclined and/or rounded portions are formed, which are configured such that the male part, during the downward movement thereof, automatically is guided into the female part, this during a joining according to the fold-down principle and/or during joining via a plane-parallel downward movement; said guiding surfaces 48 and 49 form examples thereof;

the coupling parts at the first pair and/or second pair of edges are configured such that in coupled condition a so-called pretension is existing, which forces the respective floor panels at the respective edges towards each other, wherein this preferably is performed by applying overlapping contours, and wherein the pretension is the result of a deformation, either an elastic bending or an elastic compression, or a combination of both; an example thereof has already been described herein above in greater detail by means of the bent lip 12A in FIG. 6;

the coupling parts at the second pair of edges are free from hook and loop fasteners and/or adhesive connections;

the floor panel is provided with chamfers, such as bevels, on the first and/or second pair of edges;

the floor panel has a top layer and/or decor layer which extends in one piece from the horizontal upper surface of the floor panel up to the chamfers;

the chamfers are formed by impressions;

the floor panel has a top layer with a decor, which top layer is indicated in the figures by reference 57;

the floor panels comprise a substrate 52, which is or is not consisting of multiple pieces and does or does not consist of a plurality of substrate layers 53-54, wherein the substrate, or, in the case of a plurality of layers, at least one of the substrate layers consists of a material fulfilling one or more, or any combination of the following characteristics, as far as such combination is not contradictory:

synthetic material-based material, foamed or not foamed, "resilient" or hard, whether or not with plasticizer, and whether or not filled with wood-based or bamboo-based material, for example, in the form of fibers, chips, dust or sawdust, and/or filled with other substances, for example, chalk, lime, talcum, ground fillers based on stone species;

synthetic material-based material, which is foamed with fine pores, such that the majority of the synthetic material-based material comprises pores and/or gas inclusions having dimensions smaller than 1 mm, and better smaller than 0.1 mm and still better smaller than 0.01 mm, by which is meant that in the majority of the volume of the respective material thus there are no larger pores present and/or that on average the pores match the aforementioned dimensions;

synthetic material-based material, which is obtained by extruding synthetic material-based starting material in the form of plate material, wherein, in a preferred embodiment, this material is foamed, this in its turn preferably with fine pores which are such that the majority of the synthetic material-based material, as aforementioned, comprises pores and/or gas inclusions having dimensions smaller than 1 mm, and better smaller than 0.1 mm and still better smaller than 0.01 mm; synthetic material-based material, which is obtained by strewing synthetic material-based starting material, whether or not combined with other materials, by means of a strewing process and consolidating it under the influence of pressure and possibly increased temperature in the form of plate material, wherein in a preferred embodiment the obtained material is foamed, this in its turn preferably with fine pores, which are such that the majority of the synthetic material-based material, as aforementioned, comprises pores and/or gas inclusions having dimensions smaller than 1 mm, and better smaller than 0.1 mm and still better smaller than 0.01 mm; synthetic material consisting of, or on the basis of, or comprising one of the following materials: PP, PE, PET, PUR, PVC, PIR or other suitable synthetic materials;

synthetic material-based material with plasticizers, wherein the synthetic material-based material preferably is chosen from the materials mentioned in the preceding paragraph;

wood-based material, for example, MDF, HDF, prefabricated wood panels, more particularly so-called engineered wood panels, possibly with adapted core or end strips, wherein in the last case then preferably the coupling part 6 and/or the coupling part 7 is realized in the adapted core or adapted end strip; by "adapted" is meant that in respect to a classic panel an adapted material is applied for the core or for one or more end strips, which is better suitable for realizing coupling parts 8 and/or 9 herein;

the floor panel is made as one of the following kinds:

as a laminate floor panel;

as a so-called "resilient floor panel";

a "LVT" panel or "CVT panel" or comparable thereto panel on the basis of another synthetic material than vinyl;

a floor panel with a first synthetic material-based, preferably foamed, substrate layer, with thereon a preferably thinner second substrate layer of or on the basis of vinyl or another synthetic material;

as a floor panel with a hard synthetic material-based substrate.

It is noted that said vertically active locking system VL and horizontally active locking system HL of the first pair of edges 2-3 can be realized in any manner Preferably, however, to this aim, as represented in FIG. 5, for the vertically active locking system VL use shall be made of a tongue 58 and a groove 59, which groove preferably is bordered by a lower lip 60 and an upper lip 61. For the horizontally active locking system, use is made of locking parts 62 and 63, which are provided at the tongue and the groove and which, in coupled condition, hook behind each other. Herein, it is preferred that the lower lip 60 distally extends to beyond the upper lip 61 and that the locking part 63 also shows a locking surface, which is situated beyond the distal end of the upper lip 61.

Further, it is noted that in the embodiment of FIG. 6 the fourth locking part 21 is realized as a more or less triangular nose-shaped protruding part in the wall of the female part. Herein, it is also noted that other forms of locking parts in the second contact zone C2 are not excluded. So, for example, the locking parts concerned can be realized respectively, for example, as a rounded protrusion and cooperating, preferably also rounded, recess. In FIG. 7 schematically two possible embodiments thereof are illustrated. According to a first possibility, the locking parts are realized as rounded parts fitting into each other, which are bent out towards the male part, more particularly according to line 65. According to an alternative, they are bent outward in respect to the male part, for example, as indicated by line 66. In view of the fact that all combinations of characteristics are possible, it is clear that this further can be combined with the specific characteristics of the second and/or third and/or fourth aspect.

It is noted that according to a deviating alternative embodiment, the coupling parts at the first pair of edges do not necessarily have to be able to be coupled by a turning movement, however, indeed are configured at least such that they can be coupled to each other by a downward movement. In that case, on the first pair of edges, too, coupling parts can be applied with characteristics such as those claimed in the preceding claims for the second pair of edges. The coupling parts at both pairs of edges then possibly can be made identical to each other. Such floor panel then can be coupled by downward movement, plane-parallel to the floor, to surrounding floor panels. It is noted that this is a deviating embodiment, however, that the invention shows its advantages best with floor panels which can be installed according to the fold-down principle.

According to another, then indeed clearly deviating alternative embodiment, which preferably indeed is applied in combination with the fold-down principle, there is no vertical locking in the first contact zone, which means that there is no mechanical vertically active locking and solely a horizontal locking is present, as exemplified by dashed tangent line T1A in FIG. 14. This then means that the contact surfaces in the first contact zone C1 are vertical or, seen from the male locking part, are inclined from the bottom towards the top in outward direction. Such deviation can be integrated in each of the aforementioned embodiments according to preceding aspects, by which then new aspects are obtained. Then, too, at least a number of the obtained combinations remain new and inventive.

According to the invention, the term tangent line can be interpreted in a number of different ways. In general, hereby a line has to be understood which is tangential between two cooperating contact surfaces; the location where this tangent line is considered can be random; however, usually this has to be considered in an average position, or thus the global tangent line has to be considered, unless this is defined otherwise. Alternatively, according to this application the term tangent line may also be replaced by the direction of the cooperating contact surfaces or the average or global direction or global tangent line thereof.

Deviating or more specific definitions for the tangent line, which can be applied according to alternatives, are the following:

when the second and fourth locking part define a plurality of tangent lines, for example, because the cooperating contact surfaces are not flat, then the tangent line from the second contact zone is taken, which forms the smallest angle with the horizontal;

when the second and fourth locking part define a plurality of tangent lines, for example, because the cooperating contact surfaces are not flat, then the tangent line from the second contact zone is taken, which is determined by the middle of the second contact zone;

when the first and third locking part define a plurality of tangent lines, for example, because the cooperating contact surfaces are not flat, then the tangent line from the first contact zone is taken, which forms the largest angle with the horizontal;

when the first and third locking part define a plurality of tangent lines, for example, because the cooperating contact surfaces are not flat, then the tangent line from the first contact zone is taken, which is determined by the middle of the first contact zone.

Further, it is noted that the terms distal side of the male part and proximal side of the female part usually also comprise the extensions of these sides up to the upper side of the floor panel.

By contact surfaces and contact zones, also a line contact may be understood; a contact surface or contact zone basically is the location where, in coupled condition and with a possible load, the actual contact is brought about. When speaking about extensions of contact surfaces, by this the real extensions of the surfaces have to be understood, next to the specific location where the actual contact is existing. In this case, this does not relate to a theoretical, not-present extension.

By "substrate layers situated directly above each other", it is not excluded that possibly glue is present between these layers, or a thin layer, such as a reinforcement fleece, for example, glass fleece or the like.

By coupling parts which are substantially manufactured from the material of the floor panel is meant that at least the substantial components thereof are formed in one piece from the material of the floor panel and that at least all locking parts and locking elements are realized in one piece from the material of the floor panel. In other words, this means that no separate locking strips are applied, such as elastically bendable locking strips (for example, as known under the denominations "Multifit", "5G" and the like). The above does not exclude, for example, that the coupling parts applied according to the invention can be provided with a coating or the like. The above also does not exclude that the coupling parts are formed in one piece in edge strips which consist of a special material choice and which are taken up in the edges of the substrate of the floor panel, such as known, for example, from the manufacture of so-called engineered wood panels.

References V and H represent the vertical and horizontal directions.

According to a particular characteristic, the middle of the contact zone C2 is situated at a vertical distance VD2 underneath the upper side of the floor panel, which is at least 0.25, and better at least 0.28 and still better at least 0.30 times the overall thickness THP of the floor panel. Subordinate thereto is preferred that the middle of the contact zone C2 is situated at a distance VD1 from the lower side which is at least 0.35 and still better at least 0.40 times the thickness THP. This is particularly useful with thin floor panels of 5 mm or less and/or with floor panels of the "resilient" type, more particularly LVT and the like. This idea can also be applied independently, only making use of the aforementioned "basic characteristics" of the edges.

It is clear that with the aforementioned term that the tangent lines T1 and T2 are inclined towards each other from their respective contact zones, it is not only meant that they meet each other in an intersection in upward direction, but also that this intersection is located between a vertical through the first contact zone and a vertical through the second contact zone. In other words, this means that in one and the same cross-section one of the tangent lines from the top to the bottom is tilted to the left, whereas the other tangent line then is tilted to the right.

It is clear that the invention can be applied at least with oblong rectangular as well as square floor panels, with classic installation patterns as well as with special installation patterns, for example, herringbone patterns.

It is clear that, when it is stated that "the lower hook-shaped part at the distal side of its distal end is free from vertically active mechanical locking parts", by this is meant that there no "mechanical" parts engage or sit behind each other which counteract a taking apart in upward direction. Herein, a frictional contact is possible indeed, anyhow, as illustrated in the respective embodiments, however, preferably no contact at all will exist.

The invention can be applied to relatively thin floor panels for forming a floor covering, for example of 4 mm or thinner, as well as to thicker floor panels.

As can be derived from all embodiments, this always relates to embodiments wherein the coupling parts at the second pair of edges in resting position define contours which, when presented to each other, come to sit vertically behind each other at the first and third locking part, and thus this does not relate to locking parts which first have to be brought into the position by means of an actuator, such as known, for example, from U.S. Pat. No. 9,260,870 B2.

In other words, the first and third locking part define contours at their contact surfaces, which contours engage behind each other solely by an own snap effect of the lower hook-shaped part.

In still other words, a lower hook-shaped part is applied, of which the upward-directed locking element 13 performs an elastic to- and fro-movement during coupling, wherein more particularly the female part first is pressed open in order to subsequently close in an elastic manner.

However, this does not exclude that an extra support portion, such as 33B, can be applied, additionally to the locking element 13 which closes by its own elasticity, in order to additionally counteract, in the final closed condition, an elastic backward movement. Such support portion 33B then does not function as an actuator, but only as an extra locking.

The present invention is in no way limited to the embodiments described herein above and represented in the figures, on the contrary may such floor panels be realized according to various variants, without leaving the scope of the present invention.

The invention claimed is:

1. A floor panel for forming a floor covering, wherein this floor panel comprises a first pair of opposite edges, and a second pair of opposite edges;

wherein the first pair of opposite edges comprises first coupling parts, which allow that two of such floor panels mutually can be coupled to each other, and wherein said first coupling parts show the following characteristics:

the first coupling parts comprise a first horizontally active locking system, which, in a coupled condition of two of such floor panels, effects a locking in a plane of the floor panels and perpendicular to the first pair of opposite edges;

the first coupling parts comprise a first vertically active locking system, which, in the coupled condition of two of such floor panels, effects a locking transverse to the plane of the floor panels;

the first coupling parts substantially are realized from the material of the floor panel itself; and the first coupling parts are configured such that two of such panels can be coupled to each other at the first pair of opposite edges by a turning movement;

wherein the second pair of opposite edges comprises second coupling parts, which allow that two of such floor panels mutually can be coupled to each other, wherein said second coupling parts show the following characteristics:

the second coupling parts comprise a second horizontally active locking system, which, in the coupled condition of two of such floor panels, effects a locking in the plane of the floor panels and perpendicular to the second pair of opposite edges;

the second coupling parts comprise a second vertically active locking system, which, in the coupled condition of two of such floor panels, effects a locking transverse to the plane of the floor panels;

the second coupling parts substantially are realized from the material of the floor panel itself;

the second horizontally active locking system of the second pair of opposite edges is formed at least of an upward-directed lower hook-shaped part which is situated at a first edge of the second pair of edges, and a downward-directed upper hook-shaped part, which is situated on a second edge of the second pair of edges, wherein the lower hook-shaped part defines a lip with an upward-directed locking element, which proximally thereof defines a female part in a form of a recess, whereas the upper hook-shaped part has a lip with a downward-directed locking element forming a male part;

the second coupling parts are configured such that two of such floor panels can be coupled to each other at the first and second edges by a downward movement of the one floor panel in respect to the other;

the second horizontally active locking system comprises horizontally active locking parts, which by respective contact surfaces, define at least a first contact zone, the horizontally active locking parts comprise a first locking part at a proximal side of the downward-directed locking element and a third locking part at a proximal side of the upward-directed locking element;

the first and third locking parts, in the coupled condition of two of such floor panels, define said first contact zone;

the second vertically active locking system comprises vertically active locking parts, which, by respective contact surfaces, define at least a second contact zone, the vertically active locking parts comprise a second locking part at a distal side of the male part, and a fourth locking part at a proximal end of the upward-directed lower hook-shaped part;

the second and fourth locking parts, in the coupled condition of two of such floor panels, define said second contact zone;

the lower hook-shaped part comprises at a distal side of a distal end a fifth locking part, wherein a sixth locking part is provided at a proximal end of the downward-directed upper hook-shaped part;

wherein in the coupled condition of the second pair of opposite edges of two such panels, the second vertically active locking comprises the engagement of the fifth locking part at the distal side of the distal end of the lower hook-shaped part with the sixth locking part at the proximal end of the downward-directed upper hook-shaped part;

wherein at a lower side of the lip of the lower hook-shaped part, a recess is defined as extending up to the distal end of the lip and is arranged to allow a bending of the lip in the downward direction.

2. The floor panel of claim 1, wherein the first and third locking parts, have contact surfaces which, in the coupled condition, define and are arranged along a first inclined tangent line; and/or wherein the second and fourth locking parts have contact surfaces, which, in the coupled condition, define and are arranged along a second inclined tangent line.

3. The floor panel of claim 2, wherein there is a horizontal locking but no vertical locking in the first contact zone.

4. The floor panel of claim 3, wherein the sixth locking part provided at the proximal end of the downward-directed upper hook-shaped part comprises or is provided by a protrusion; and wherein the fifth locking part at the distal side of the distal end of the lower-hook-shaped part comprises or is provided by a recess or an undercut.

5. The floor panel of claim 4, wherein the fifth locking part at the distal side of the distal end of the lower-hook-shaped part comprises or is provided by said recess, wherein said recess is present at a lower side of the lower hook-shaped part, and extends from a certain location at the lower side up to an end of the lower hook-shaped part.

6. The floor panel of claim 4, wherein the second pair of edges also shows the following characteristics:

at the male part, at a height lower than the second contact zone, a contact surface is provided, which, in the coupled condition, together with a contact surface on the coupled floor panel, forms a support point which limits the movement of the male part in downward direction; and the contact surfaces forming said support point are situated on a lower side of the male part and on the upper side of the lip of the lower hook-shaped part, respectively, wherein in the coupled condition, seen in cross-section, spaces between the lower side of the male part and the upper side of said lip are present on the left and on the right of the support point.

7. The floor panel of claim 6, wherein the upward-directed locking element, the downward-directed locking element and the contact surfaces of the first contact zone are configured such that the upward-directed locking element with a first contact surface in the coupled condition adopts a tilted position in respect to a position which the first contact surface adopts in a free condition; and that the contact surfaces of the first contact zone in a not-coupled condition mutually are oriented deviating in such a manner that in the coupled condition a less deviating or not deviating orientation in mutual respect is obtained.

8. The floor panel of claim 7, wherein floor panel is synthetic material-based floor panel.

9. The floor panel of claim 7, wherein the floor panel comprises a substrate and the first and second coupling parts substantially are realized from the substrate, wherein the substrate comprises a synthetic material.

10. The floor panel of claim 9, wherein the synthetic material is foamed.

11. The floor panel of claim 9, wherein the synthetic material is filled with chalk, lime, talcum or ground fillers based on stone species.

12. The floor panel of claim 11, wherein the synthetic material is obtained by extruding synthetic material in the form of plate material.

13. The floor panel of claim 12, wherein the synthetic material comprises one of the following materials: PP, PUR, PET, PVC, PIR.

14. The floor panel of claim 13, wherein the floor panel has a thickness of at most 8 mm or at most 5 mm.

15. The floor panel of claim 14, wherein the floor panel is rectangular, wherein the coupling parts are configured such that the floor panels can be installed in a floor covering by a fold-down installation method.

16. A floor panel for forming a floor covering, wherein the floor panel comprises a substrate, wherein the substrate comprises a synthetic material, said synthetic material comprising one of the following materials: PP, PUR, PET, PVC, PIR and said synthetic material being filled with chalk, lime, talcum or ground fillers based on stone species;

wherein this floor panel comprises a first pair of opposite edges, and a second pair of opposite edges;

wherein the first pair of opposite edges comprises first coupling parts, which allow that two of such floor panels mutually can be coupled to each other, and wherein said first coupling parts show the following characteristics:

the first coupling parts comprise a first horizontally active locking system, which, in a coupled condition of two of such floor panels, effects a locking in a plane of the floor panels and perpendicular to the first pair of opposite edges;

the first coupling parts comprise a first vertically active locking system, which, in the coupled condition of two of such floor panels, effects a locking transverse to the plane of the floor panels;

the first coupling parts substantially are realized from the substrate of the floor panel; and the first coupling parts are configured such that two of such panels can be coupled to each other at the first pair of opposite edges by a turning movement;

wherein the second pair of opposite edges comprises second coupling parts, which allow that two of such floor panels mutually can be coupled to each other, wherein said second coupling parts show the following characteristics:

the second coupling parts comprise a second horizontally active locking system, which, in the coupled condition of two of such floor panels, effects a locking in the plane of the floor panels and perpendicular to the second pair of opposite edges;

the second coupling parts comprise a second vertically active locking system, which, in the coupled condition of two of such floor panels, effects a locking transverse to the plane of the floor panels;

the second coupling parts substantially are realized from the substrate of the floor panel;

the second horizontally active locking system of the second pair of opposite edges is formed at least of an upward-directed lower hook-shaped part which is situated at a first edge of the second pair of edges, and a downward-directed upper hook-shaped part, which is situated on a second edge of the second pair of edges, wherein the lower hook-shaped part defines a lip with an upward-directed locking element, which proximally thereof defines a female part in a form of a recess, whereas the upper hook-shaped part has a lip with a downward-directed locking element forming a male part;

the second coupling parts are configured such that two of such floor panels can be coupled to each other at the first and second edges by a downward movement of the one floor panel in respect to the other;

the second horizontally active locking system comprises horizontally active locking parts, which by respective contact surfaces, define at least a first contact zone, the horizontally active locking parts comprise a first locking part at a proximal side of the downward-directed locking element and a third locking part at a proximal side of the upward-directed locking element;

the first and third locking parts, in the coupled condition of two of such floor panels, define said first contact zone; while having contact surfaces which, in the coupled condition, define and are arranged along a first inclined tangent line;

wherein there is a horizontal locking but no vertical locking in the first contact zone;

the second vertically active locking system comprises vertically active locking parts, which, by respective contact surfaces, define at least a second contact zone, the vertically active locking parts comprise a second locking part at a distal side of the male part, and a fourth locking part at a proximal end of the upward-directed lower hook-shaped part;

the second and fourth locking parts, in the coupled condition of two of such floor panels, define said second contact zone, while having contact surfaces, which, in the coupled condition, define and are arranged along a second inclined tangent line;

the lower hook-shaped part comprises at a distal side of a distal end a fifth locking part, wherein a sixth locking part is provided at a proximal end of the downward-directed upper hook-shaped part;

wherein in the coupled condition of the second pair of opposite edges of two such panels, the second vertically active locking comprises the engagement of the fifth locking part at the distal side of the distal end of the lower hook-shaped part with the sixth locking part at the proximal end of the downward-directed upper hook-shaped part.

17. The floor panel of claim 16, wherein the sixth locking part is provided at the proximal end of the downward-directed upper hook-shaped part and comprises or is provided by a protrusion; and wherein the fifth locking part at the distal side of the distal end of the lower-hook-shaped part comprises or is provided by a recess, wherein the recess is present at a lower side of the lower hook-shaped part, and extends from a certain location at the lower side up to an end of the lower hook-shaped part.

18. The floor panel of claim 17, wherein the second pair of edges also shows the following characteristics:

at the male part, at a height lower than the second contact zone, a contact surface is provided, which, in the coupled condition, together with a contact surface on the coupled floor panel, forms a support point which limits the movement of the male part in downward direction; and the contact surfaces forming said support point are situated on a lower side of the male part and on the upper side of the lip of the lower hook-shaped part, respectively, wherein in the coupled condition, seen in cross-section, spaces between the lower side of the male part and the upper side of said lip are present on the left and on the right of the support point.

19. The floor panel of claim 18, wherein a first angle of the first inclined tangent line with the horizontal is larger than a second angle of the second inclined tangent line with the horizontal, wherein the difference between the first and second angles is at least 5 degrees.

20. The floor panel of claim 19, wherein the floor panel is rectangular, wherein the coupling parts are configured such that the floor panels can be installed in a floor covering by a fold-down installation method.

* * * * *